US011049458B1

(12) United States Patent
Fan et al.

(10) Patent No.: US 11,049,458 B1
(45) Date of Patent: Jun. 29, 2021

(54) PIXEL DRIVING CIRCUIT, DRIVING METHOD AND ORGANIC LIGHT EMITTING DISPLAY PANEL

(71) Applicant: Shanghai Tianma AM-OLED Co., Ltd., Shanghai (CN)

(72) Inventors: Longfei Fan, Shanghai (CN); Xingyao Zhou, Shanghai (CN); Yana Gao, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 16/909,056

(22) Filed: Jun. 23, 2020

(30) Foreign Application Priority Data

Apr. 9, 2020 (CN) ..... 202010275697.9

(51) Int. Cl.
*G09G 3/3266* (2016.01)

(52) U.S. Cl.
CPC ... *G09G 3/3266* (2013.01); *G09G 2300/0809* (2013.01); *G09G 2310/06* (2013.01)

(58) Field of Classification Search
CPC .. G09G 3/3266; G09G 3/3291; G09G 3/3233; G09G 3/3258; G09G 2320/0247
See application file for complete search history.

(56) References Cited

U.S. PATENT DOCUMENTS 10,242,622 B2 * 3/2019 Tseng ..... G09G 3/325
10,796,625 B2 * 10/2020 Zhou ..... G09G 3/22
2016/0321995 A1 * 11/2016 Shin ..... H01L 27/3276
2017/0365647 A1 * 12/2017 Choi ..... G09G 3/3233
2019/0130832 A1 5/2019 Chang
2019/0295470 A1 * 9/2019 Kim ..... G09G 3/3233
2020/0286432 A1 * 9/2020 Zhang ..... G09G 3/3275

FOREIGN PATENT DOCUMENTS

CN 104575394 A 4/2015
CN 106097964 A 11/2016
CN 107316613 A 11/2017
CN 109215585 A 1/2019
CN 110277060 A 9/2019

OTHER PUBLICATIONS

First Chinese Office Action, dated Feb. 5, 2021, issued in corresponding Chinese Application No. 202010275697.9, filed Apr. 9, 2020, 31 pages.

* cited by examiner

*Primary Examiner* — Sardis F Azongha
(74) *Attorney, Agent, or Firm* — Christensen O'Connor Johnson Kindness PLLC

(57) ABSTRACT

Provided is a pixel driving circuit, a driving method and an organic light emitting display panel. The pixel driving circuit includes: a light emitting display module, including an OLED; a light emission driving module, including a first control terminal, a first input terminal and a first output terminal, the first output terminal being electrically connected to the light emitting display module; a connection control module, including a second input terminal and a second output terminal, the second output terminal being connected to the first control terminal of the light emission driving module; and a first initializing module, including a third input terminal and a third output terminal, the third input terminal being connected to a first reference voltage signal line and the third output terminal being connected to the second input terminal.

19 Claims, 10 Drawing Sheets

PIXEL DRIVING CIRCUIT, DRIVING METHOD AND ORGANIC LIGHT EMITTING DISPLAY PANEL

CROSS-REFERENCE TO RELATED APPLICATIONS

The present application claims priority to Chinese Patent Application No. 202010275697.9, filed on Apr. 9, 2020, the content of which is incorporated herein by reference in its entirety.

TECHNICAL FIELD

The present disclosure relates to the field of display technologies, and particularly, to a pixel driving circuit, a driving method and an organic light emitting display panel.

BACKGROUND

Organic light emitting display is currently a mainstream technology for displays in e.g., mobile phones, televisions, computers, and the like. Compared with the conventional liquid crystal display, the organic light emitting display has advantages such as low power consumption, low cost, auto-luminescence, wide viewing angle and high response speed. As a result, the organic light emitting display has gradually become the mainstream display technology.

Since the organic light emitting display is current-driven, a stable current is required for controlling its light emission. An amplitude and stability of a driving current of the organic light emitting display mainly depend on an amplitude and stability of a voltage transmitted to an organic light emitting device from a driving transistor in an organic light emitting display pixel circuit. In the related art, due to a current leakage problem with other transistors connected to a gate of the driving transistor, a potential at the gate of the driving transistor may be unstable, and thus a voltage it transmits to the organic light emitting device may be unstable, resulting in a flicker problem with the organic light emitting display.

SUMMARY

In view of the above, the present disclosure provides a pixel driving circuit, a driving method and an organic light emitting display panel, to solve the above problem.

In a first aspect, a pixel driving circuit is provided according to an embodiment of the present disclosure. The pixel driving circuit includes: a light emitting display module, including an Organic Light Emitting Diode (OLED); a light emission driving module, including a first control terminal, a first input terminal and a first output terminal, the first output terminal being electrically connected to the light emitting display module; a connection control module, including a second input terminal and a second output terminal, the second output terminal being connected to the first control terminal of the light emission driving module; and a first initializing module, including a third input terminal and a third output terminal, the third input terminal being connected to a first reference voltage signal line and the third output terminal being connected to the second input terminal.

In a second aspect, a driving method for a pixel driving circuit is provided according to an embodiment of the present disclosure. The pixel driving circuit includes: a light emitting display module, including an Organic Light Emitting Diode (OLED); a light emission driving module, including a first control terminal, a first input terminal and a first output terminal, the first output terminal being electrically connected to the light emitting display module; a connection control module, including a second input terminal and a second output terminal, the second output terminal being connected to the first control terminal of the light emission driving module; and a first initializing module, including a third input terminal and a third output terminal, the third input terminal being connected to a first reference voltage signal line and the third output terminal being connected to the second input terminal. The driving method includes: in an initializing phase, connecting the third input terminal and the third output terminal of the first initializing module with each other, connecting the second input terminal and the second output terminal of the connection control module with each other, and transmitting a reference voltage on the first reference voltage signal line, the reference voltage being transmitted to the first control terminal through the first initializing module and the connection control module; and in a light emitting phase, disconnecting the third input terminal and the third output terminal of the first initializing module from each other, disconnecting the second input terminal and the second output terminal of the connection control module from each other, and the light emission driving module transmitting a light emission driving voltage to the light emitting display module.

In a third aspect, an organic light emitting display panel is provided according to an embodiment of the present disclosure. The organic light emitting display panel includes the pixel driving circuit according to the first aspect.

A connection control module is provided between the third output terminal of the first initializing module and the first control terminal of the light emission driving module. The input terminal and the output terminal of the first initializing module can be disconnected from each other and the input terminal and the output terminal of the connection control module can be disconnected from each other in the light emitting phase of the pixel driving circuit, so as to avoid a current leakage due to the first initializing module not being completely turned off in the light emitting phase, which would otherwise affect the voltage at the first control terminal of the light emission driving module. In this way, the stability of light emission from the OLED in the light emission driving circuit can be guaranteed.

BRIEF DESCRIPTION OF DRAWINGS

In order to illustrate technical solutions of embodiments of the present disclosure, the accompanying drawings used in the embodiments or the prior art are introduced hereinafter. These drawings illustrate some embodiments of the present disclosure. On the basis of these drawings, those skilled in the art can also obtain other drawings.

DESCRIPTION OF EMBODIMENTS

In order to better understand technical solutions of the present disclosure, the embodiments of the present disclosure will be described in detail with reference to the drawings.

It should be clear that the described embodiments are merely part of the embodiments of the present disclosure rather than all the embodiments. All other embodiments obtained by those skilled in the art shall fall into the protection scope of the present disclosure.

The terms used in the embodiments of the present disclosure are merely for the purpose of describing specific embodiments, rather than limiting the present disclosure. The singular form "a", "an", "the" and "said" used in the embodiments and claims shall be interpreted as also including the plural form, unless indicated otherwise in the context.

It should be understood that, the term "and/or" is used in the present disclosure merely to describe relations between associated objects, and thus includes three types of relations. That is, A and/or B can represent: (a) A exists alone; (b) A and B exist at the same time; or (c) B exists alone. In addition, the character "/" generally indicates "or".

It is to be noted that, while transistors may be described using terms such as "first", "second" and "third" in the embodiments of the present disclosure, they are not limited by these terms which are used for distinguishing the transistors from one another only. For example, a first transistor may be referred to as a second transistor, without departing from the scope of the embodiments of the present disclosure. Likewise, a second transistor may be referred to as a first transistor.

The inventors of the present disclosure have studied the problems with the related art to provide a solution.

Figure 1:
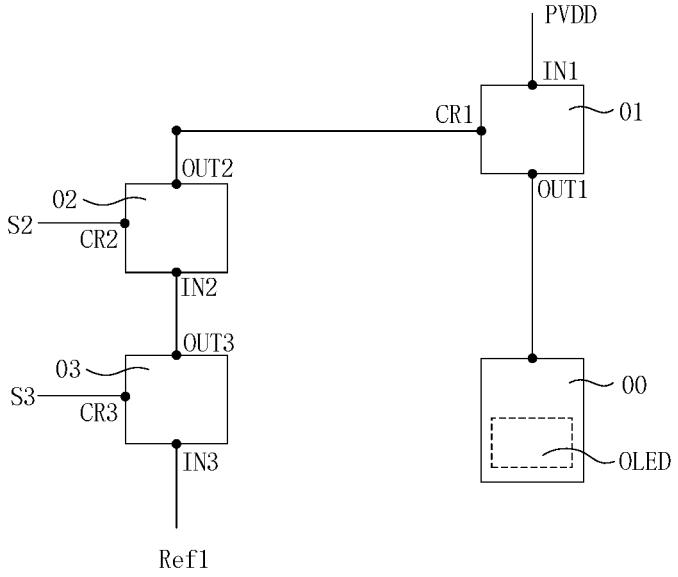
FIG. 1 is a schematic diagram showing a pixel driving circuit according to an embodiment of the present disclosure.

FIG. 1 is a schematic diagram showing a pixel driving circuit according to an embodiment of the present disclosure. As shown in FIG. 1, the pixel driving circuit according to the embodiment of the present disclosure includes a light emitting display module 00, a light emission driving module 01, a connection control module 02, and a first initializing module 03.

The light emitting display module 00 includes an Organic Light Emitting Diode (OLED) for light emitting and displaying.

The light emission driving module 01 includes a first control terminal CR1, a first input terminal IN1 and a first output terminal OUT1. The first output terminal OUT1 is electrically connected to the light emitting display module 00. Specifically, the light emission driving module 01 may provide an anode voltage for an anode of the OLED in the light emitting display module 00, while a cathode of the OLED receives a cathode voltage transmitted on a cathode signal line PVEE. The OLED emits light in response to the anode voltage and the cathode voltage.

The connection control module 02 includes a second input terminal IN2 and a second output terminal OUT2. The second output terminal OUT2 is connected to the first control terminal CR1 of the light emission driving module 01. In addition, the connection control module 02 may further include a second control terminal CR2 connected to a first scan line S2 and used to control the connected/disconnected state between the second input terminal IN2 and the second output terminal OUT2 of the connection control module 02. When the second input terminal IN2 and the second output terminal OUT2 of the connection control module 02 are connected with each other, the first control terminal CR1 of the light emission driving module 01 can receive a signal through the connection control module 02. When the second input terminal IN2 and the second output terminal OUT2 of the connection control terminal 02 are disconnected from each other, the connection control module 02 can cut off the signal transmission between the first control terminal CR1 of the light emission driving module 01 and other signal lines and/or other transistors.

The first initializing module 03 includes a third input terminal IN3 and a third output terminal OUT3. The third input terminal IN3 is connected to a first reference voltage signal line Ref1, and the third output terminal OUT3 is connected to the second input terminal IN2. In addition, the first initializing module 03 further includes a third control terminal CR3, which is connected to a second scan line S3 and used to control the connected/disconnected state between the third input terminal IN3 and the third output terminal OUT3 of the first initializing module 03. When the third input terminal IN3 and the third output terminal OUT3 of the first initializing module 03 are connected with each other, a reference voltage transmitted on the first reference voltage signal line Ref1 can be transmitted to the turned-on connection control module 02 through the turned-on first initializing module 03, and then transmitted to the first control terminal CR1 of the light emission driving module 01, so as to complete initialization of the first control terminal CR1 of the light emission driving module 01.

The connection control module 02 is provided between the third output terminal OUT3 of the first initializing module 03 and the first control terminal CR1 of the light emission driving module 01. In the light emitting phase of the pixel driving circuit, the third input terminal IN3 and the third output terminal OUT3 of the first initializing module 03 can be disconnected from each other and the second input terminal IN2 and the second output terminal OUT2 of the connection control module 02 can be disconnected from each other, so as to avoid a current leakage due to the first initializing module 03 not being completely turned off in the light emitting phase, which would otherwise affect the voltage at the first control terminal CR1 of the light emission driving module 01. In this way, the stability of light emission from the OLED in the light emission driving circuit can be guaranteed.

In the following, the operation principles of the pixel driving circuit according to the embodiment of the present disclosure will be explained with reference to the timing sequence.

Figure 2:
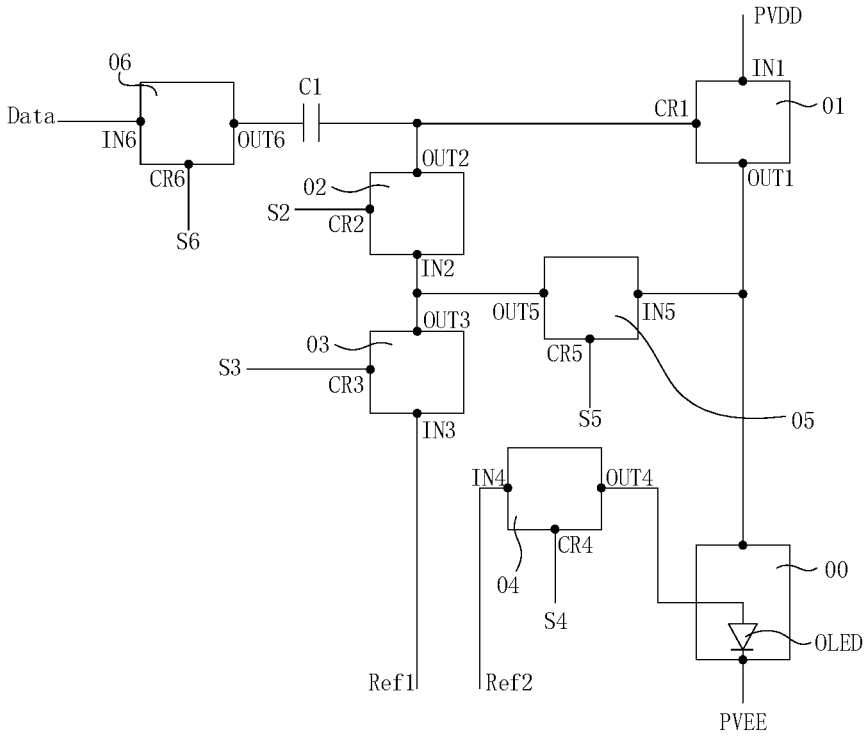
FIG. 2 is a schematic diagram showing another pixel driving circuit according to an embodiment of the present disclosure.
Figure 3:
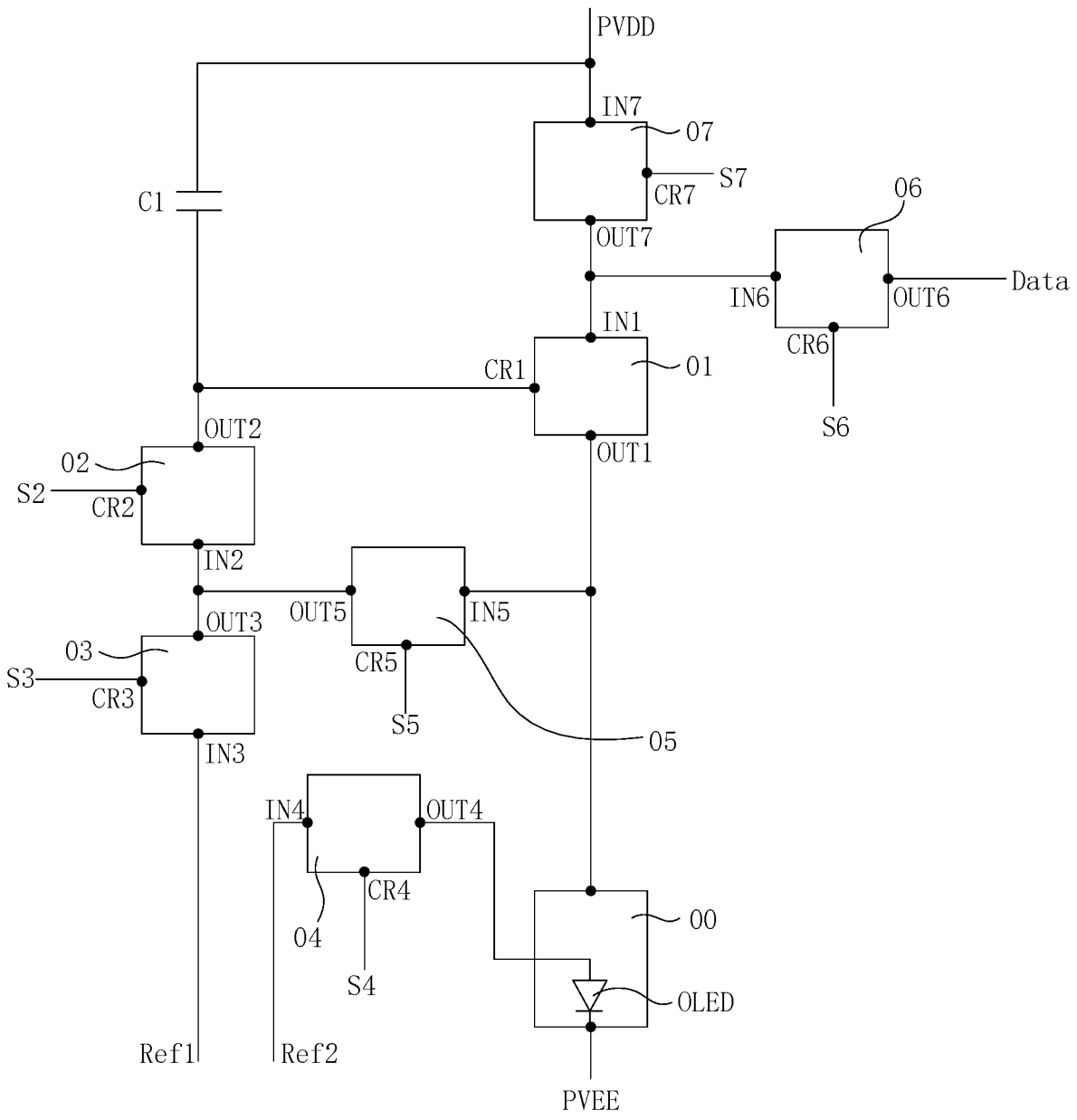
FIG. 3 is a schematic diagram showing yet another pixel driving circuit according to an embodiment of the present disclosure.
Figure 4:
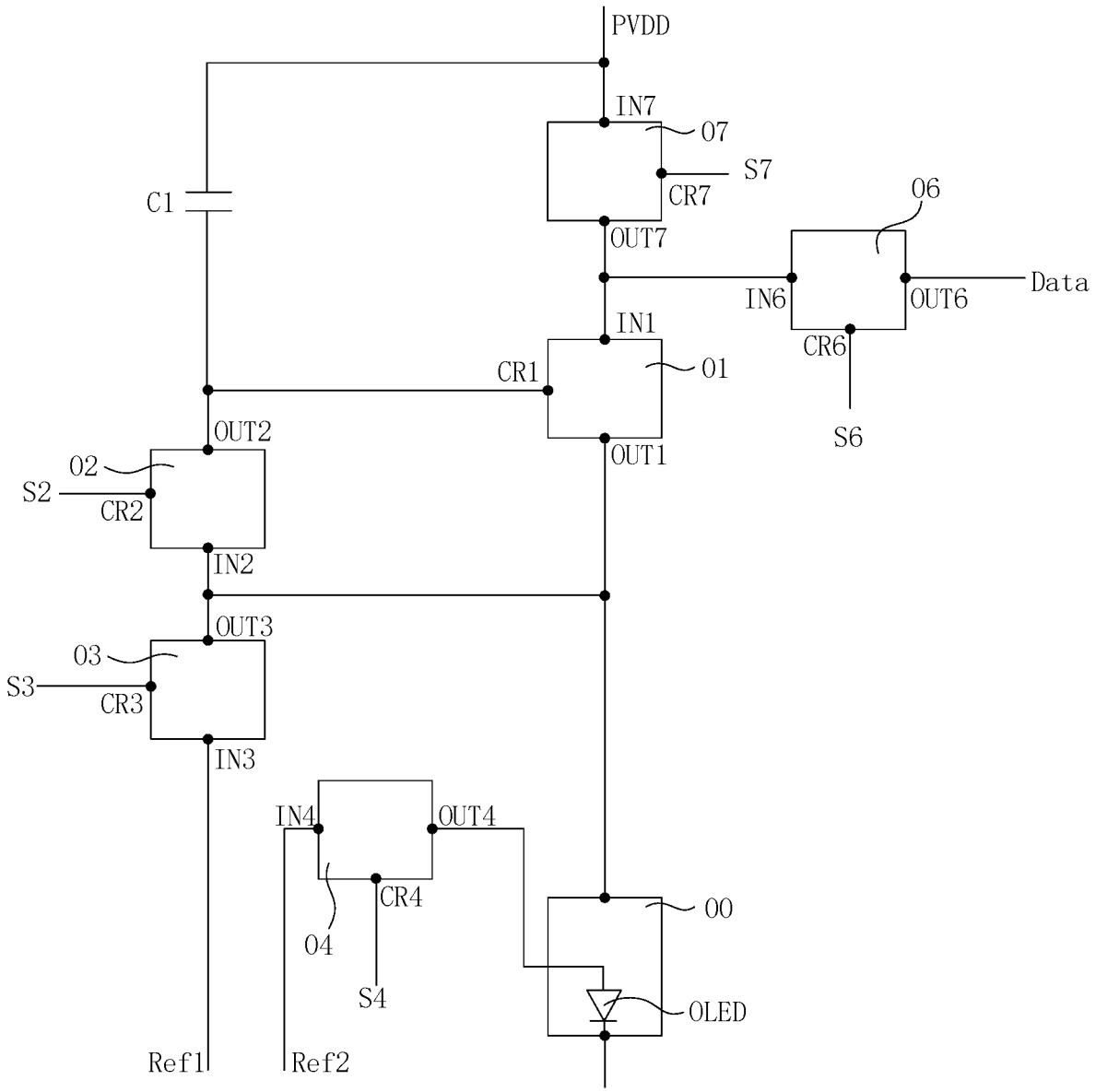
FIG. 4 is a schematic diagram showing still another pixel driving circuit according to an embodiment of the present disclosure.
Figure 5:
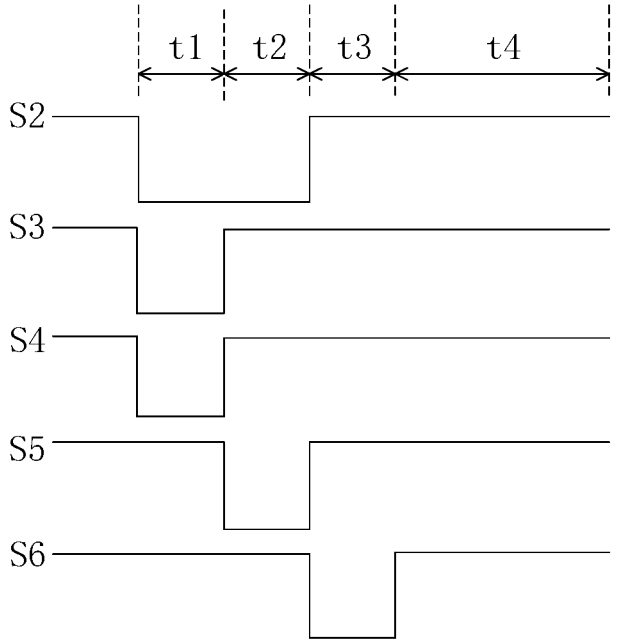
FIG. 5 shows a driving timing sequence of a pixel driving circuit according to an embodiment of the present disclosure.
Figure 6:
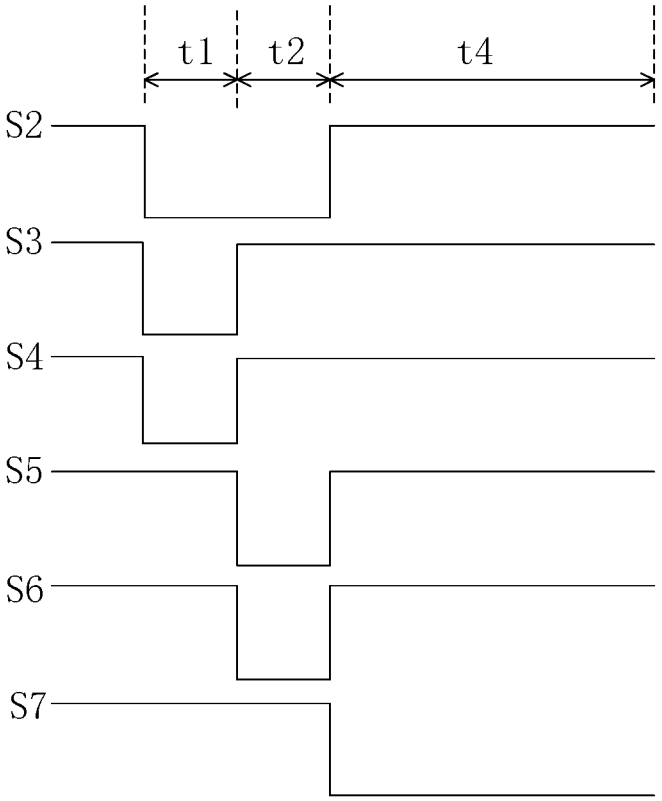
FIG. 6 shows a driving timing sequence of another pixel driving circuit according to an embodiment of the present disclosure.
Figure 7:
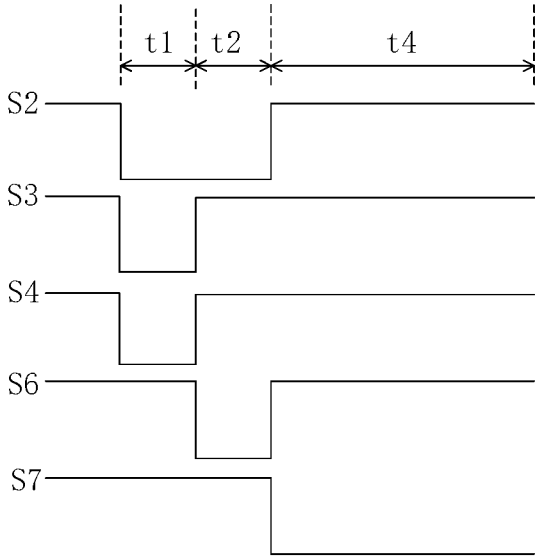
FIG. 7 shows a driving timing sequence of yet another pixel driving circuit according to an embodiment of the present disclosure.

FIG. 2 is a schematic diagram showing another pixel driving circuit according to an embodiment of the present disclosure. FIG. 3 is a schematic diagram showing yet another pixel driving circuit according to an embodiment of the present disclosure. FIG. 4 is a schematic diagram showing still another pixel driving circuit according to an embodiment of the present disclosure. FIG. 5 shows a driving timing sequence of a pixel driving circuit according to an embodiment of the present disclosure. FIG. 6 shows a driving timing sequence of another pixel driving circuit according to an embodiment of the present disclosure. FIG. 7 shows a driving timing sequence of yet another pixel driving circuit according to an embodiment of the present disclosure. Here, FIG. 5 shows the driving timing sequence of the pixel driving circuit shown in FIG. 2; FIG. 6 shows the driving timing sequence of the pixel driving circuit shown in FIG. 3; and FIG. 7 shows the driving timing sequence of the pixel driving circuit shown in FIG. 4.

As shown in FIGS. 5-7, an operation period of the pixel driving circuit includes a plurality of cycles, each including an initializing phase t1 and a light emitting phase t4. For illustration, this embodiment will be described with reference to an example where a low level is used as an "on" signal (enabling level) and a high level is used as an "off" signal (disabling level). In fact, alternatively, for each module, a high level can be used as an on signal and a low level can be used as an off signal. It is to be noted here that the on signal is a signal that controls the input terminal and the output terminal of each module to be connected with each other, and the off signal is a signal that controls the input terminal and the output terminal of each module to be disconnected from each other.

In the initializing phase t1, the first scan line S2 receives an on signal, and the second control terminal CR2 of the connection control module 02 receives the on signal and controls the second input terminal IN2 and the second output terminal OUT2 to be connected with each other. That is, a signal at the second input terminal IN2 can be transmitted to the second output terminal OUT2. At the same time, the second scan line S3 receives an on signal, and the third control terminal CR3 of the first initializing module 03 receives the on signal and controls the third input terminal IN3 and the third output terminal OUT3 to be connected with each other. That is, a signal at the third input terminal IN3 can be transmitted to the third output terminal OUT3. At the same time, a reference voltage is transmitted on the first reference voltage signal line Ref1 connected to the third input terminal IN3 of the first initializing module 03, and the reference voltage is transmitted to the first control terminal CR1 of the light emission driving module 01 through the turned-on first initializing module 03 and connection control module 02, so as to initialize the first control terminal CR1 of the light emission driving module 01.

In the light emitting phase t4, both the first scan line S2 and the second scan line S3 receive an off signal. The second control terminal CR2 of the connection control module 02 receives the off signal and controls the second input terminal IN2 and the second output terminal OUT2 to be disconnected from each other, and the third control terminal CR3 of the first initializing module 03 receives the off signal and controls the third input terminal IN3 and the third output terminal OUT3 to be disconnected from each other.

Since in the light emitting phase the second input terminal IN2 and the second output terminal OUT2 of the connection control module 02 are disconnected from each other and the third output terminal OUT3 of the first initializing module 03 and the first control terminal CR1 of the light emission driving module 01 are also disconnected from each other, even if the first initializing module 03 is not completely turned off, the connection control module 02 disconnects the first initializing module 03 from the first control terminal CR1 of the light emission driving module 01, thereby guaranteeing the stability of the voltage at the first control terminal CR1 of the light emission driving module 01.

In an embodiment of the present disclosure, referring to FIGS. 2-4 again, the pixel driving circuit according to an embodiment of the present disclosure may further include a second initializing module 04, which includes a fourth input terminal IN4 and a fourth output terminal OUT4. The fourth input terminal IN4 is connected to a second reference voltage signal line Ref2, and the fourth output terminal OUT4 is connected to an anode of the OLED. In addition, the second initializing module 04 further includes a fourth control terminal CR4, which is connected to a third scan line S4 and used to control connection/disconnection between the fourth input terminal IN4 and the fourth output terminal OUT4 of the second initializing module 04. When the fourth input terminal IN4 and the fourth output terminal OUT4 of the second initializing module 04 are connected with each other, a reference voltage transmitted on the second reference voltage signal line Ref2 can be transmitted to the anode of the OLED through the turned-on second initializing module 04, so as to complete the initialization of the anode of the OLED.

Referring to FIGS. 5-7 again, in the initializing phase t1, the third scan line S4 receives an on signal, and the fourth control terminal CR4 of the second initializing module 04 receives an on signal and controls the fourth input terminal IN4 and the fourth output terminal OUT4 to be connected with each other. That is, a signal at the fourth input terminal IN4 can be transmitted to the fourth output terminal OUT4. At the same time, a reference voltage is transmitted on the second reference voltage signal line Ref2 connected to the fourth input terminal IN4 of the second initializing module 04, and the reference voltage is transmitted to the anode of the OLED through the turned-on second initializing module 04, so as to complete the initialization of the anode of the OLED.

In the light emitting phase t4, the third scan line S4 receives an off signal, and the fourth control terminal CR4 of the second initializing module 04 receives an off signal and controls the fourth input terminal IN4 and the fourth output terminal OUT4 to be disconnected from each other.

It should be noted that, as shown in FIGS. 5 and 7, the initialization of the first control terminal CR1 of the light emission driving module 01 by the first initializing module 03 and the initialization of the anode of the OLED by the second initializing module 03 can be performed simultaneously, i.e., they can be completed in one initializing phase t1. However, according to a different operation timing requirement, the initialization of the first control terminal CR1 of the light emission driving module 01 by the first initializing module 03 and the initialization of the anode of the OLED by the second initializing module 03 can be performed separately. For example, the first control terminal CR1 can be initialized first and then the anode of the OLED can be initialized.

Referring to FIG. 2 to FIG. 3, the pixel driving circuit according to the embodiment of the present disclosure may further include a threshold voltage capturing module 05 and a first capacitor C1. The threshold voltage capturing module 05 includes a fifth input terminal IN5 and a fifth output terminal OUT5. The fifth input terminal IN5 is connected to the first output terminal OUT1 of the light emission driving module 01, and the fifth output terminal OUT5 is connected to the second input terminal IN2 of the connection control module 02. In addition, the threshold voltage capturing module 05 further includes a fifth control terminal CR5, which is connected to a fourth scan line S5 and used to control connection/disconnection between the fifth input terminal IN5 and the fifth output terminal OUT5 of the threshold voltage capturing module 05. A first electrode plate of the first capacitor C1 is electrically connected to the first control terminal CR1 of the light emission driving module 01.

The purpose of providing the threshold voltage capturing module 05 is to store the voltage at the first input terminal IN1 of the light emission driving module 01 to the first control terminal CR1 of the light emission driving module 01 in a threshold voltage capturing phase before the light emitting phase. In the light emitting phase, while the light emission driving module 01 is outputting a light emission driving voltage, the impact of the threshold voltage of the light emission driving module 01 on the light emission driving voltage is eliminated, thereby achieving a threshold compensation. Since the light emission driving voltage of the light emission driving module 01 is determined by a power supply voltage and a data voltage, one of the power supply voltage and the data voltage can be stored to the first control terminal CR1 of the light emission driving module 01 in the threshold voltage capturing phase. That is, in the threshold voltage capturing phase, the threshold voltage capturing module 05 may store the power supply voltage or the data voltage at the first input terminal IN1 to the first control terminal CR1. The function of the first capacitor C1 includes storing the voltage at the first control terminal CR1 of the light emission driving module 01 connected thereto.

In the following, a circuit structure corresponding to the threshold voltage capturing module 05 storing the power supply voltage and the data voltage to the first control terminal CR1 of the light emission driving module 01 in the threshold voltage capturing phase will be described.

Referring to FIG. 2, when the threshold voltage capturing module 05 stores the power supply voltage to the first control terminal CR1 of the light emission driving module 01 in the threshold voltage capturing phase, the pixel driving circuit according to the embodiment of the present disclosure may further include a data signal writing module 06. The data signal writing module 06 includes a sixth input terminal IN6 and a sixth output terminal OUT6. The sixth input terminal IN6 is connected to a data voltage line Data, and the sixth output terminal OUT6 is electrically connected to a second electrode plate of the first capacitor C1. The first input terminal IN1 of the light emission driving module 01 is connected to a power supply voltage signal line PVDD. In addition, the data signal writing module 06 further includes a sixth control terminal CR6 connected to a fifth scan line S6 and used to control connection/disconnection between the sixth input terminal IN6 and the sixth output terminal OUT6 of the data signal writing module 06.

Referring to FIG. 2 and FIG. 5 again, in the threshold voltage capturing phase t2, the first scan line S2 and the fourth scan line S5 receive an on signal, and the second control terminal CR2 of the connection control module 02 receives the on signal and controls the second input terminal IN2 and the second output terminal OUT2 to be connected with each other. That is, the signal at the second input terminal IN2 can be transmitted to the second output terminal OUT2. The fifth control terminal CR5 of the threshold voltage capturing module 05 receives the on signal and controls the fifth input terminal IN5 and the fifth output terminal OUT5 to be connected with each other. That is, the signal at the fifth input terminal IN5 can be transmitted to the fifth output terminal OUT5. At the same time, in the threshold voltage capturing phase t2, the first input terminal IN1 and the first output terminal OUT1 of the light emission driving module 01 are connected with each other and a power supply voltage is transmitted on the power supply voltage signal line PVDD. The power supply voltage is transmitted through the light emission driving module 01, the threshold voltage capturing module 05 and the connection control module 02 and stored to the first control terminal CR1 of the light emission driving module 01.

Referring to FIG. 2 and FIG. 5 again, in a data signal writing phase t3, the fifth scan line S6 receives an on signal, and the sixth control terminal CR6 of the data signal writing module 06 receives the on signal and controls the sixth input terminal IN6 and the sixth output terminal OUT6 to be connected with each other. That is, the signal at the sixth input terminal IN6 can be transmitted to the sixth output terminal OUT6. A data voltage is transmitted on the data voltage line Data, and the data voltage is transmitted through the data signal writing module 06 and stored in the first capacitor, equivalently stored to the first control terminal CR1 of the light emission driving module 01.

Referring to FIG. 2 and FIG. 5 again, in the light emitting phase t4, the fourth scanning line S5 and the fifth scanning line S6 receive an off signal, the fifth control terminal CR5 of the threshold voltage capturing module 05 receives the off signal and controls the fifth input terminal IN5 and the fifth output terminal OUT5 to be disconnected from each other, and the sixth control terminal CR6 of the data signal writing module 06 receives the off signal and controls the sixth input terminal IN6 and the sixth output terminal OUT6 to be disconnected from each other.

The connection control module 02 is provided between the third output terminal OUT3 of the first initializing module 03 and the first control terminal CR1 of the light emission driving module 01, and between the first output terminal OUT1 and the first control terminal CR1 of the light emission driving module 01. In the light emitting phase of the pixel driving circuit, the second input terminal IN2 and the second output terminal OUT2 of the connection control module 02 are disconnected from each other, and the third output terminal OUT3 of the first initializing module 03 and the first output terminal OUT1 of the light emission driving module 01 are disconnected simultaneously and effectively from the first control terminal CR1 of the light emission driving module 01, so as to avoid a current leakage and guarantee the stability of the voltage at the first control terminal CR1 of the light emission driving module 01, thereby guaranteeing the stability of light emission from the OLED in the light emission driving circuit.

Referring to FIG. 3 and FIG. 6, when the threshold voltage capturing module 05 stores the data voltage to the first control terminal CR1 of the light emission driving module 01 in the threshold voltage capturing phase t2, the pixel driving circuit according to the embodiment of the present disclosure may further include a data signal writing module 06 and a power supply voltage writing module 07.

Referring to FIG. 3 again, the data signal writing module 06 includes a sixth input terminal IN6 and a sixth output terminal OUT6. The sixth input terminal IN6 is connected to a data voltage line Data, and the sixth output terminal OUT6 is connected to the first input terminal IN1 of the light emission driving module 01. In addition, the data signal writing module 06 further includes a sixth control terminal CR6 connected to a fifth scan line S6 and used to control connection/disconnection between the sixth input terminal IN6 and the sixth output terminal OUT6 of the data signal writing module 06.

Referring to FIG. 3 again, the power supply voltage writing module 07 includes a seventh input terminal IN7 and a seventh output terminal OUT7. The seventh input terminal IN7 is connected to a power supply voltage signal line PVDD, and the seventh output terminal OUT7 is connected to the first input terminal IN1 of the light emission driving module 01. In addition, the power supply voltage writing module 07 further includes a seventh control terminal CR7 connected to a sixth scan line S7 and used to control connection/disconnection between the seventh input terminal IN7 and the seventh output terminal OUT7 of the power supply voltage writing module 07.

Referring to FIG. 3 and FIG. 6 again, in the threshold voltage capturing phase t2, the first scan line S2 and the fifth scan line S6 receive an on signal, the second control terminal CR2 of the connection control module 02 receives the on signal and controls the second input terminal IN2 and the second output terminal OUT2 to be connected with each other. That is, the signal at the second input terminal IN2 can be transmitted to the second output terminal OUT2. The sixth control terminal CR6 of the data signal writing module 06 receives the on signal and controls the sixth input terminal IN6 and the sixth output terminal OUT6 to be connected with each other. That is, the signal at the sixth input terminal IN6 can be transmitted to the sixth output terminal OUT6. At the same time, in the threshold voltage capturing phase t2, the first input terminal IN1 and the first output terminal OUT1 of the light emission driving module 01 are connected with each other and a data voltage is transmitted on the data voltage line Data. The data voltage is transmitted through the data signal writing module 06, the light emission driving module 01, the threshold voltage capturing module 05 and the connection control module 02 and stored to the first control terminal CR1 of the light emission driving module 01.

It should be noted that the threshold voltage capturing phase t2 in this embodiment completes writing the data voltage to the first control terminal CR1 of the light emission driving module 01. That is, this phase equivalently completes both the writing of the data signal and the capturing of the threshold voltage. Thus, the pixel circuit corresponding to the embodiment of the present disclosure does not need to perform a separate data signal writing phase in operation, which shortens the scanning period of the pixel driving circuit for each row.

Referring to FIG. 3 and FIG. 6 again, in the light emitting phase t4, the fourth scan line S5 and the fifth scan line S6 receive an off signal, the fifth control terminal CR5 of the threshold voltage capturing module 05 receives the off signal and controls the fifth input terminal IN5 and the fifth output terminal OUT5 to be disconnected from each other, and the sixth control terminal CR6 of the data signal writing module 06 receives the off signal and controls the sixth input terminal IN6 and the sixth output terminal OUT6 to be disconnected from each other. In addition, the sixth scan line S7 receives an on signal and a power supply voltage is transmitted on the power supply voltage signal line PVDD. The seventh control terminal CR7 of the power supply voltage writing module 07 receives the on signal and controls the seventh input terminal IN7 and the seventh output terminal OUT7 to be connected with each other. That is, the signal at the seventh input terminal IN7 can be transmitted to the seventh output terminal OUT7. The power supply voltage can be transmitted through the power supply voltage writing module 07 to form a light emission driving voltage to be transmitted to the light emitting display module 01.

The connection control module 02 is provided between the third output terminal OUT3 of the first initializing module 03 and the first control terminal CR1 of the light emission driving module 01, and between the first output terminal OUT1 and the first control terminal CR1 of the light emission driving module 01. In the light emitting phase of the pixel driving circuit, the second input terminal IN2 and the second output terminal OUT2 of the connection control module 02 are disconnected from each other. The third output terminal OUT3 of the first initializing module 03 and the first output terminal OUT1 of the light emission driving module 01 can be disconnected simultaneously and effectively from the first control terminal CR1 of the light emission driving module 01, so as to avoid a current leakage and guarantee stability of voltage at the first control terminal CR1 of the light emission driving module 01, thereby guaranteeing stability of light emission from the OLED in the light emission driving circuit.

The pixel driving circuit shown in FIG. 4 differs from the pixel driving circuit shown in FIG. 3 only in that the threshold voltage capturing module is not included, so that the second input terminal IN2 of the connection control module 02 is connected to the first output terminal OUT1 of the light emission driving module 01 directly.

Referring to FIG. 4 and FIG. 7, in the threshold voltage capturing phase t2, the first scan line S2 and the fifth scan line S6 receive an on signal, the second control terminal CR2 of the connection control module 02 receives the on signal and controls the second input terminal IN2 and the second output terminal OUT2 to be connected with each other. That is, the signal at the second input terminal IN2 can be transmitted to the second output terminal OUT2. The sixth control terminal CR6 of the data signal writing module 06 receives the on signal and controls the sixth input terminal IN6 and the sixth output terminal OUT6 to be connected with each other. That is, the signal at the sixth input terminal IN6 can be transmitted to the sixth output terminal OUT6. At the same time, in the threshold voltage capturing phase t2, the first input terminal IN1 and the first output terminal OUT1 of the light emission driving module 01 are connected with each other and a data voltage is transmitted on the data voltage line Data. The data voltage is transmitted through the data signal writing module 06, the light emission driving module 01 and the connection control module 02 and stored to the first control terminal CR1 of the light emission driving module 01. It can be seen that the connection control module 02 can function as the threshold voltage capturing module 02 in the threshold voltage capturing phase t2. The stability of the voltage at the first control terminal CR1 of the light emission driving module 01 can be effectively maintained by setting the position of the connection control module 02, while reducing the number of transistors and increasing the aperture area for transmissive display.

Figure 8:
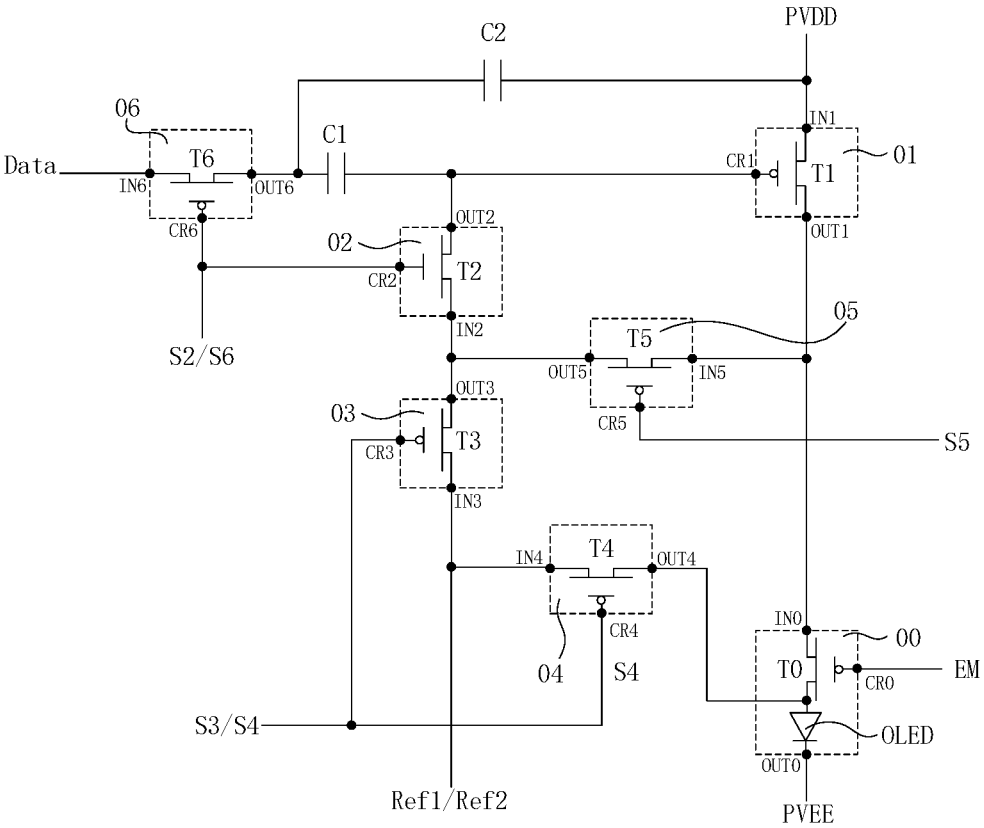
FIG. 8 is an equivalent circuit diagram of a pixel driving circuit according to an embodiment of the present disclosure.
Figure 9:
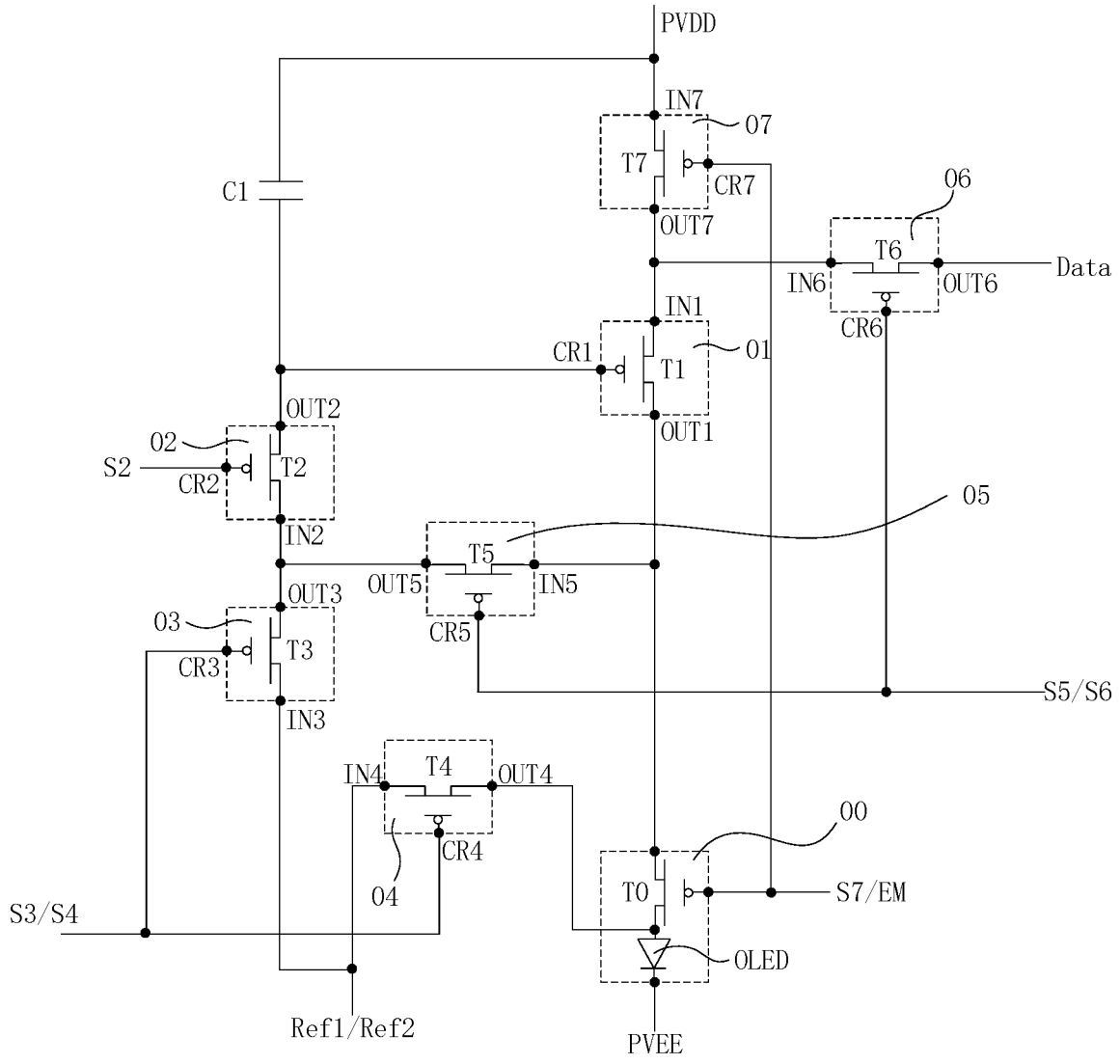
FIG. 9 is an equivalent circuit diagram of another pixel driving circuit according to an embodiment of the present disclosure.
Figure 10:
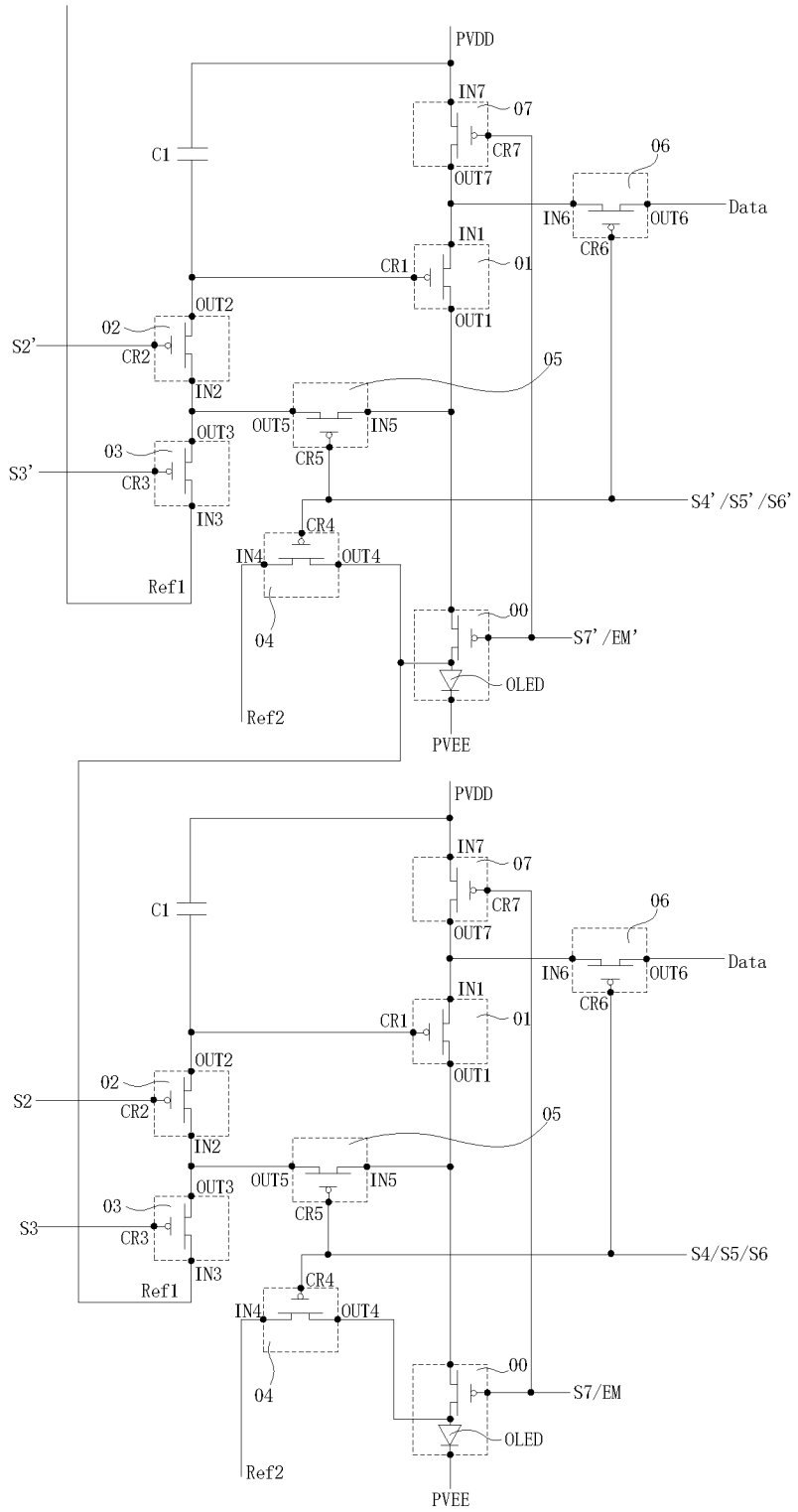
FIG. 10 is an equivalent circuit diagram of yet another pixel driving circuit according to an embodiment of the present disclosure.
Figure 11:
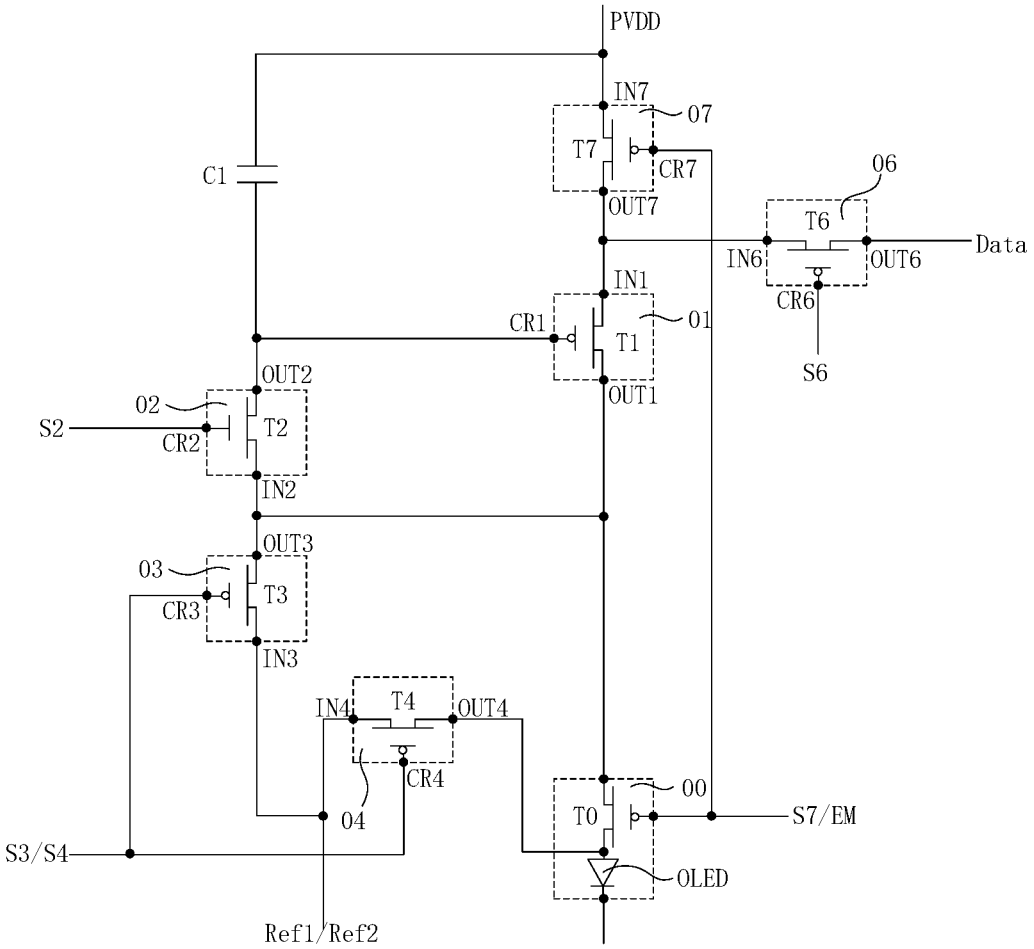
FIG. 11 is an equivalent circuit diagram of still another pixel driving circuit according to an embodiment of the present disclosure.

FIG. 8 is an equivalent circuit diagram of a pixel driving circuit according to an embodiment of the present disclosure. FIG. 9 is an equivalent circuit diagram of another pixel driving circuit according to an embodiment of the present disclosure. FIG. 10 is an equivalent circuit diagram of yet another pixel driving circuit according to an embodiment of the present disclosure. FIG. 11 is an equivalent circuit diagram of still another pixel driving circuit according to an embodiment of the present disclosure. The specific circuit structure of the pixel driving circuit according to the present disclosure will be described below with reference to FIGS. 8-11.

As shown in FIGS. 8-11, the light emission driving module 01 includes a first transistor T1 having a gate connected to the first control terminal CR1, a source connected to the first input terminal IN1, and a drain connected to the first output terminal OUT1. The connection control module 02 includes a second transistor T2 having a gate connected to the second control terminal CR2, a source connected to the second input terminal IN2, and a drain connected to the second output terminal OUT2. The first initializing module 03 includes a third transistor T3 having a gate connected to the third control terminal CR3, a source connected to the third input terminal IN3, and a drain connected to the third output terminal OUT3. The second initializing module 04 includes a fourth transistor T4 having a gate connected to the fourth control terminal CR4, a source connected to the fourth input terminal IN4, and a drain connected to the fourth output terminal OUT4. The threshold voltage capturing module 05 includes a fifth transistor T5 having a source connected to the fifth input terminal IN5 and a drain connected to the fifth output terminal OUT5. The data signal writing module 06 includes a sixth transistor T6 having a source connected to the sixth input terminal IN6 and a drain connected to the sixth output terminal OUT6. The power supply voltage writing module 07 includes a seventh transistor T7 having a source connected to the seventh input terminal IN7 and a drain connected to the seventh output terminal OUT7.

In addition, as shown in FIGS. 8-11, in one embodiment of the present disclosure, the light emitting display module 00 may further include a light emission control transistor T0 having a gate connected to a light emission control signal line EM, a source connected to the first output terminal OUT1 of the light emission driving module 01, and a drain connected to the anode of the OLED.

Referring to FIG. 8, in an embodiment of the present disclosure, the first input terminal IN1 of the light emission driving module 01 is connected to the power supply voltage signal line PVDD, and the first output terminal OUT1 is electrically connected to the light emitting display module 00. The second control terminal CR2 of the connection control module 02 is connected to the first scan line S2, and the second output terminal OUT2 is connected to the first control terminal CR1 of the light emission driving module 01. The third control terminal CR3 of the first initializing module 03 is connected to the second scan line S3, the third input terminal IN3 is connected to the first reference voltage signal line Ref1, and the third output terminal OUT3 is connected to the second input terminal IN2 of the connection control module 02. The fourth control terminal CR4 of the second initializing module 04 is connected to the third scan line S4, the fourth input terminal IN4 is connected to the second reference voltage signal line Ref2, and the fourth output terminal OUT4 is connected to the anode of the OLED. The fifth control terminal CR5 of the threshold voltage capturing module 05 is connected to the fourth scan line S5, the fifth input terminal IN5 is connected to the first output terminal OUT1 of the light emission driving module 01, and the fifth output terminal OUT5 is connected to the second input terminal IN2 of the connection control module 02. The sixth control terminal CR6 of the data signal writing module 06 is connected to the fifth scan line S6, the sixth output terminal OUT6 is electrically connected to the second electrode plate of the first capacitor C1, and the sixth input terminal IN6 is connected to the data voltage line Data. The first electrode plate of the first capacitor C1 is electrically connected to the first control terminal CR1 of the light emission driving module 01.

That is, as shown in FIG. 8, in this embodiment, the gate of the light emission control transistor T0 is electrically connected to the light emission control signal line EM, and the drain of the light emission control transistor T0 is electrically connected to the anode of the OLED. The gate of the first transistor T1 is electrically connected to the drain of the second transistor T2, the source of the first transistor T1 is electrically connected to the power supply voltage signal line PVDD, and the drain of the first transistor T1 is connected to the source of the light emission control transistor T0. The gate of the second transistor T2 is electrically connected to the first scan line S2, and the source of the second transistor T2 is electrically connected to the drain of the third transistor T3. The gate of the third transistor T3 is electrically connected to the second scan line S3, and the source of the third transistor T2 is electrically connected to the first reference voltage signal line Ref1. The gate of the fourth transistor T4 is electrically connected to the third scan line S4, the source of the fourth transistor T4 is electrically connected to the second reference voltage signal line Ref2, and the drain of the fourth transistor T4 is electrically connected to the anode of the OLED. The gate of the fifth transistor T5 is electrically connected to the fourth scan line S5, the source of the fifth transistor T5 is electrically connected to the drain of the first transistor T1, and the drain of the fifth transistor T5 is electrically connected to the source of the second transistor T2. The first electrode plate of the first capacitor C1 is electrically connected to the gate of the first transistor T1 and the drain of the second transistor T2. The gate of the sixth transistor T6 is electrically connected to the fifth scan line S6, the source of the sixth transistor T6 is electrically connected to the data voltage line Data, and the drain of the sixth transistor T6 is electrically connected to the second electrode plate of the first capacitor C1.

Since the first initializing module 03 and the second initializing module 04 can simultaneously initialize the first control terminal CR1 of the light emission driving module 01 and the anode of the OLED, respectively, the second scan line S3 can be reused as the third scan line S4, and the first reference voltage signal line Ref1 can be reused as the second reference voltage signal line Ref2.

In addition, in this embodiment, the sixth input terminal IN6 and the sixth output terminal OUT6 of the data signal writing module 06 are not connected to the signal lines of other transistors, and the data voltage line Data only writes signals in the data signal writing phase. Therefore, the data signal writing module 06 can share the signal lines with the control terminals of the modules that do not operate at the same time. As shown in FIG. 8, the first scan line S2 can be reused as the fifth scan line S6.

The pixel driving circuit according to this embodiment may further include a second capacitor C2 having a first electrode plate electrically connected to the second electrode plate of the first capacitor C1 and a second electrode plate electrically connected to the power supply voltage signal line PVDD. The second capacitor can stabilize the potential at the second electrode plate of the first capacitor C1.

Figure 12:
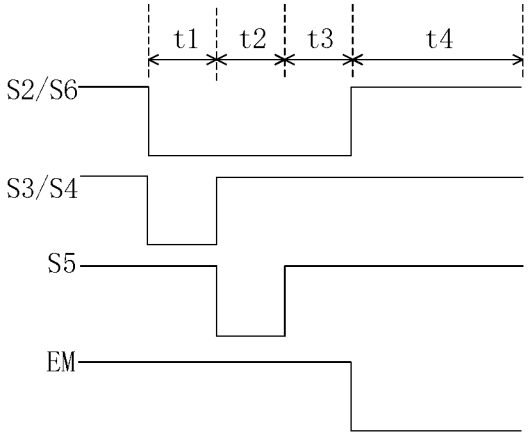
FIG. 12 is an operation timing diagram of the pixel driving circuit shown in FIG. 8.

FIG. 12 is an operation timing sequence diagram of the pixel driving circuit shown in FIG. 8. The operational principle of the pixel driving circuit shown in FIG. 8 will be described below with reference to FIG. 12.

As shown in FIG. 12, one display cycle of the pixel driving circuit shown in FIG. 8 includes an initializing phase t1, a threshold voltage capturing phase t2, a data signal writing phase t3, and a light emitting phase t4 that occur sequentially. In the following, an example will be given, in which each transistor is a P-type transistor.

In the initializing phase t1, the first scan line S2 is reused as the fifth scan line S6 and an on signal, i.e., a low-level signal, is transmitted thereon. Both the second transistor T2 and the sixth transistor T6 are turned on. The second scan line S3 is reused as the third scan line S4 and an on signal, i.e., a low-level signal, is transmitted thereon. Both the third transistor T3 and the fourth transistor T4 are turned on. The first reference voltage signal line Ref1 is reused as the second reference voltage signal line Ref2 and a reference voltage is transmitted thereon. Then, the reference voltage is transmitted to the gate of the first transistor T1 through the turned-on third transistor T3 and second transistor T2, such that the gate of the first transistor T1 is reset. The reference voltage is transmitted to the anode of the OLED through the turned-on fourth transistor T4, such that the anode of the OLED is reset. It should be noted that, since no data voltage or any other signal is transmitted on the data voltage line Data at this time, the sixth transistor T6, though turned on, will not affect the initialization.

In the threshold voltage capturing phase t2, the first scan line S2 is reused as the fifth scan line S6 and an on signal, i.e., a low-level signal, is transmitted thereon. Both the second transistor T2 and the sixth transistor T6 are turned on. An on signal, i.e., a low-level signal, is transmitted on the fourth scan line S5, and the fifth transistor T5 is turned on. At this time, a power supply voltage is transmitted on the power supply voltage signal line PVDD. Since the initializing phase t1, the potential at the gate of the first transistor T1 has been maintained at the same as the reference voltage and the power supply voltage is higher than the reference voltage, and thus the first transistor T1 is turned on, and the power supply voltage starts to be gradually stored to the gate of the light emission driving transistor T1. When the difference between the potential at the gate and the potential at the source of the first transistor T1 becomes greater than the threshold voltage, the first transistor T1 starts to be turned off.

In the data signal writing phase t3, the fifth scan line S6 is reused as the first scan line S2, and an on signal, i.e., a low-level signal, is transmitted thereon. Both the sixth transistor T6 and the second transistor T2 are turned on. At this time, since the third transistor T3 and the fifth transistor T5 that are electrically connected to the second transistor T2 are both turned off, the second transistor T2, though turned on, will not affect the writing of the data signal.

In the light emitting phase t4, an on signal, i.e., a low-level signal, is transmitted on the light emission control signal line EM, and the light emission control transistor T0 is turned on. A power supply voltage is transmitted on the power supply voltage signal line PVDD. As the difference between the potential at the gate of the first transistor T1 and the power supply voltage becomes smaller than the threshold voltage, the first transistor T1 is turned on, and the power supply voltage passes through the first transistor T1 to form a light emission driving voltage, which is transmitted to the anode of the OLED through the light emission control transistor T0.

Referring to FIG. 9, in an embodiment of the present disclosure, the first input terminal IN1 of the light emission driving module 01 is connected to the seventh output terminal OUT7 of the power supply voltage writing module 07, and the first output terminal OUT1 is electrically connected to the light emitting display module 00. The second control terminal CR2 of the connection control module 02 is connected to the first scan line S2, and the second output terminal OUT2 is connected to the first control terminal CR1 of the light emission driving module 01. The third control terminal CR3 of the first initializing module 03 is connected to the second scan line S3, the third input terminal IN3 is connected to the first reference voltage signal line Ref1, and the third output terminal OUT3 is connected to the second input terminal IN2 of the connection control module 02. The fourth control terminal CR4 of the second initializing module 04 is connected to the third scan line S4, the fourth input terminal IN4 is connected to the second reference voltage signal line Ref2, and the fourth output terminal OUT4 is connected to the anode of the OLED. The fifth control terminal CR5 of the threshold voltage capturing module 05 is connected to the fourth scan line S5, the fifth input terminal IN5 is connected to the first output terminal OUT1 of the light emission driving module 01, and the fifth output terminal OUT5 is connected to the second input terminal IN2 of the connection control module 02. The sixth control terminal CR6 of the data signal writing module 06 is connected to the fifth scan line S6, the sixth output terminal OUT6 is connected to the first input terminal IN1 of the light emission driving module 01, and the sixth input terminal IN6 is connected to the data voltage line Data. The seventh control terminal CR7 of the power supply voltage writing module 07 is connected to the sixth scan line S7, and the seventh input terminal IN1 is connected to the power supply voltage signal line PVDD. The first electrode plate of the first capacitor C1 is electrically connected to the first control terminal CR1 of the light emission driving module 01, and the second electrode plate of the first capacitor C1 is connected to the power supply voltage signal line PVDD.

That is, as shown in FIG. 9, in this embodiment, the gate of the light emission control transistor T0 is electrically connected to the light emission control signal line EM, and the drain of the light emission control transistor T0 is electrically connected to the anode of the OLED. The gate of the first transistor T1 is electrically connected to the drain of the second transistor T2, the source of the first transistor T1 is electrically connected to the drain of the seventh transistor T7, and the drain of the first transistor T1 is connected to the source of the light emission control transistor T0. The gate of the second transistor T2 is electrically connected to the first scan line S2, and the source of the second transistor T2 is electrically connected to the drain of the third transistor T3. The gate of the third transistor T3 is electrically connected to the second scan line S3, and the source of the third transistor T2 is electrically connected to the first reference voltage signal line Ref1. The gate of the fourth transistor T4 is electrically connected to the third scan line S4, the source of the fourth transistor T4 is electrically connected to the second reference voltage signal line Ref2, and the drain of the fourth transistor T4 is electrically connected to the anode of the OLED. The gate of the fifth transistor T5 is electrically connected to the fourth scan line S5, the source of the fifth transistor T5 is electrically connected to the drain of the first transistor T1, and the drain of the fifth transistor T5 is electrically connected to the source of the second transistor T2. The gate of the sixth transistor T6 is electrically connected to the fifth scan line S6, the source of the sixth transistor T6 is electrically connected to the data voltage line Data, and the drain of the sixth transistor T6 is electrically connected to the source of the first transistor T1. The gate of the seventh transistor T7 is electrically connected to the sixth scan line S7, and the source of the seventh transistor T7 is electrically connected to the power supply voltage signal line PVDD. The first electrode plate of the first capacitor C1 is electrically connected to the gate of the first transistor T1 and the drain of the second transistor T2, and the second electrode plate of the first capacitor C1 is electrically connected to the power supply voltage signal line PVDD.

Since the first initializing module 03 and the second initializing module 04 can simultaneously initialize the first control terminal CR1 of the light emission driving module 01 and the anode of the OLED, respectively, the second scan line S3 can be reused as the third scan line S4, and the first reference voltage signal line Ref1 can be reused as the second reference voltage signal line Ref2.

In addition, in the present embodiment, the power supply voltage writing module 07 and the light emission control transistor T0 only operate in the light emitting phase, so the sixth scan line S7 can be reused as the light emission control signal line EM. The data signal writing module 06 and the threshold voltage capturing module 05 only operate in the threshold voltage capturing phase, so the fourth scan line S5 can be reused as the fifth scan line S6.

Figure 13:
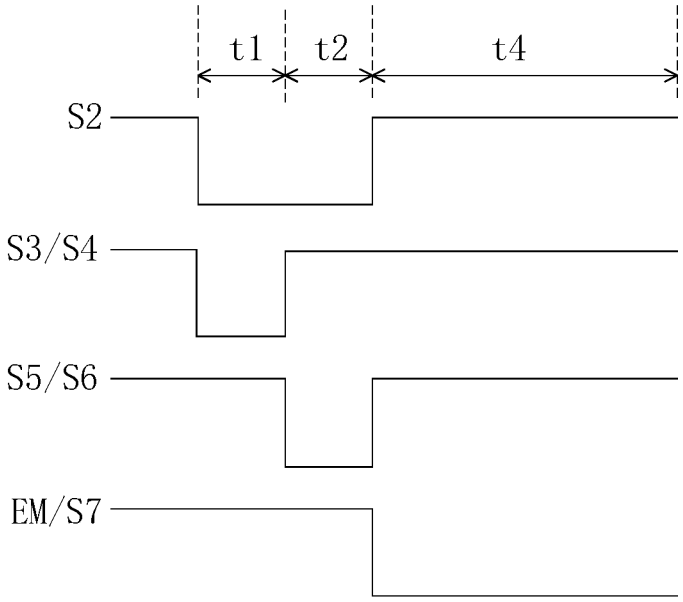
FIG. 13 is an operation timing diagram of the pixel driving circuit shown in FIG. 9.

FIG. 13 is an operation timing sequence diagram of the pixel driving circuit shown in FIG. 9. The operation principle of the pixel driving circuit shown in FIG. 9 will be described below with reference to FIG. 13.

As shown in FIG. 13, one display cycle of the pixel driving circuit shown in FIG. 9 includes an initializing phase t1, a threshold voltage capturing phase t2, and a light emitting phase t4 that occur sequentially. In the following, an example will be given, in which each transistor is a P-type transistor.

In the initializing phase t1, an on signal, i.e., a low-level signal, is transmitted on the first scan line S2, and the second transistor T2 is turned on. The second scan line S3 is reused as the third scan line S4, and an on signal, i.e., a low-level signal, is transmitted thereon. Both the third transistor T3 and the fourth transistor T4 are turned on. The first reference voltage signal line Ref1 is reused as the second reference voltage signal line Ref2, and a reference voltage is transmitted thereon. Then, the reference voltage is transmitted to the gate of the first transistor T1 through the turned-on third transistor T3 and second transistor T2, such that the gate of the first transistor T1 is reset. The reference voltage is transmitted to the anode of the OLED through the turned-on fourth transistor T4, such that the anode of the OLED is reset.

In the threshold voltage capturing phase t2, an on signal, i.e., a low-level signal, is transmitted on the first scan line S2, and the second transistor T2 is turned on. An on signal, i.e., a low-level signal, is transmitted on the fourth scan line S5 and the fifth scan line S6, and the fifth transistor T5 and the sixth transistor T6 are turned on. At this time, a data voltage is transmitted on the data voltage line Data, and the data voltage is transmitted to the source of the first transistor T1 through the turned-on sixth transistor T6. Since the initializing phase t1, the potential at the gate of the first transistor T1 has been maintained at the same as the reference voltage and the potential at the gate of the first transistor T1 is the data voltage which is higher than the reference voltage, the first transistor T1 is turned on, and the power supply voltage starts to be gradually stored to the gate of the light emission driving transistor T1. When the difference between the potential at the gate and the potential at the source of the first transistor T1 becomes greater than the threshold voltage, the first transistor T1 starts to be turned off. It is to be noted that, in the threshold voltage capturing phase t2, the data voltage is in fact written into the first control terminal CR1 of the light emission driving module 01, so equivalently both the writing of the data signal and the capturing of the threshold voltage are completed in the threshold voltage capturing phase t2.

In the light emitting phase, an on signal, i.e., a low-level signal, is transmitted on the sixth scan line S7 and the light emission control signal line EM, and the seventh transistor T7 and the light emission control transistor T0 are turned on. A power supply voltage is transmitted on the power supply voltage signal line PVDD, and the power supply voltage is transmitted to the source of the first transistor T1 through the turned-on seventh transistor T7. Since the difference between the potential at the gate of the first transistor T1 and the power supply voltage is smaller than the threshold voltage, the first transistor T1 is turned on and the power supply voltage passes through the first transistor T1 to form a light emission driving voltage, which is transmitted to the anode of the OLED through the light emission control transistor T0.

The above has been described with reference to the example in which the first reference voltage signal line Ref1 is reused as the second reference voltage signal line Ref2 in the initializing phase t1. FIG. 10 shows a case where the first reference voltage signal line Ref1 is not reused as the second reference voltage signal line Ref2 in the initializing phase t1. As known, the pixel driving circuits are arranged in multiple rows and columns to implement the display. As shown in FIG. 10, a pixel driving circuit has other pixel driving circuits in adjacent rows.

The pixel driving circuit shown in FIG. 10 differs from the pixel driving circuit shown in FIG. 9 mainly in that the first reference voltage signal line Ref1 is not reused as the second reference voltage signal line Ref2 in one pixel driving circuit, but the first reference voltage signal line Ref1 in one pixel driving circuit is connected to the anode of the OLED in the pixel driving circuit at a previous stage. Here, the pixel driving circuit at the previous stage refers to the pixel driving circuit that is initialized and emits light earlier than the one pixel driving circuit.

In addition, as shown in FIG. 10, the pixel driving circuit is completely the same as the pixel driving circuit shown in FIG. 9 in terms of connections among the transistors, and the difference between them includes the reusing schemes of the scan lines corresponding to the respective transistors. Specifically, the third scan line S4/S4' electrically connected to the gate of the fourth transistor T4 is reused as the fourth scan line S5/S5' electrically connected to the gate of the fifth transistor T5 and the fifth scan line S6/S6' electrically connected to the gate of the sixth transistor T6.

Figure 14:
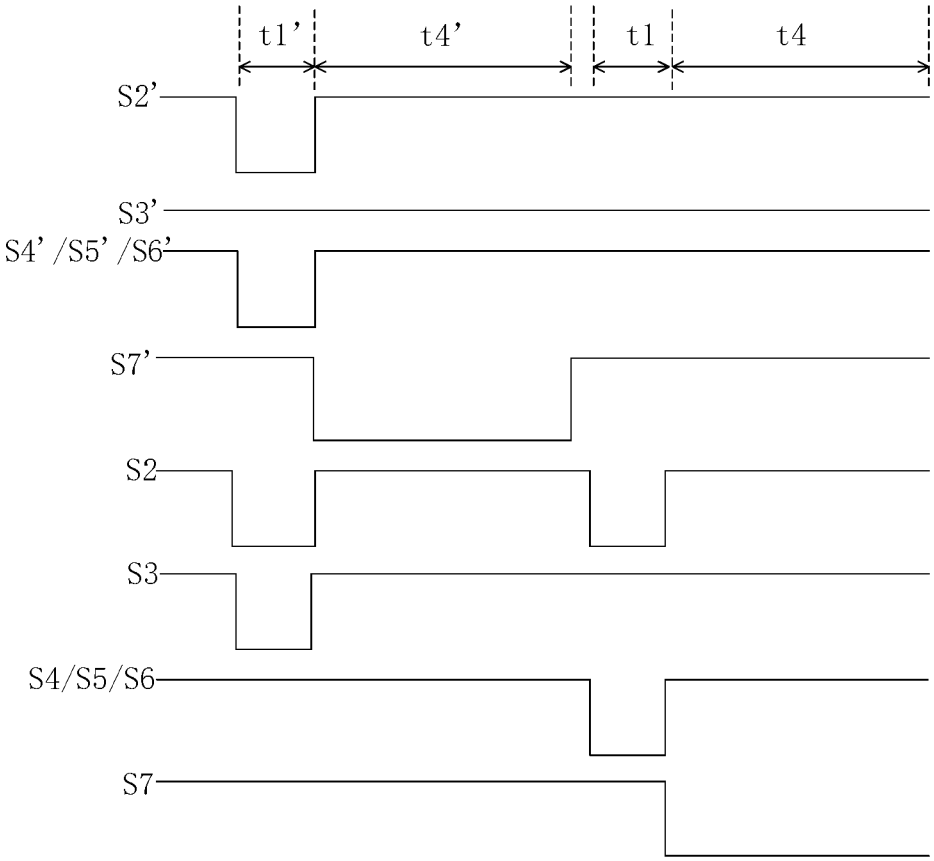
FIG. 14 is an operation timing diagram of the pixel driving circuit shown in FIG. 10.

FIG. 14 is an operation timing sequence diagram of the pixel driving circuit shown in FIG. 10, and the operation principle of the pixel driving circuit shown in FIG. 10 will be described below with reference to FIG. 14. It should be noted that, as there are some differences between the operation timing sequence of a pixel driving circuit and that of a pixel driving circuit at the previous stage, for the purpose of illustration, in the pixel driving circuit at the previous stage, the first scan line is denoted as S2', the second scan line is denoted as S3', the third scanning line is denoted as S4', the fourth scanning line is denoted as S5', the fifth scanning line is denoted as S6', the sixth scanning line is denoted as S7', and the light emission control signal line is denoted as EM'.

As shown in FIG. 14, one cycle of the pixel driving circuit at the current stage and one cycle of the pixel driving circuit at the previous stage each include two phases, an initializing phase t1/t1' and a light emitting phase t4/t4'.

During the operation of the pixel driving circuit at the current stage, in the initializing phase t1, an on signal is transmitted on the first scan line S2. The third scan line S4 is reused as the fourth scan line S5 and the fifth scan line S6, and an on signal is transmitted thereon. Thus, the second transistor T2, the fourth transistor T4, the fifth transistor T5, and the sixth transistor T6 are turned on. A data voltage is transmitted on the data voltage line Data, and the data voltage is transmitted to the gate of the first transistor T1 through the sixth transistor T6, the first transistor T1, the fifth transistor T5, and the second transistor T2 and stored in the first capacitor C1. At the same time, a reference voltage is transmitted on the second reference voltage signal line Ref2, and the reference voltage is transmitted to the anode of the OLED through the turned-on fourth transistor T4 to initialize the OLED.

The initializing phase t1' and the light emitting phase t4' of the pixel driving circuit at the previous stage are similar. However, it should be noted that in the initializing phase t1' of the pixel driving circuit at the previous stage, the process for initializing the anode of the corresponding OLED is also the process of initializing the light emission driving module 01 (i.e., the first transistor T1) of the pixel driving circuit at the current stage. Specifically, in the initializing phase t1' of the pixel driving circuit at the previous stage, an on signal is transmitted on the first scan line S2 and the third scan line of the pixel driving circuit at the current stage, that is, the second transistor T2 and the third transistor T3 are turned on. The reference voltage received by the anode of the OLED in the pixel driving circuit at the previous stage is transmitted to the gate of the first transistor T1 through the third transistor T3 and the second transistor T2 in the pixel driving circuit at the current stage, so that the gate of the first transistor T1 is initialized.

In this embodiment, for pixel driving circuits at two adjacent stages, the first reference voltage signal line in the pixel driving circuit at one stage is connected to the anode of the OLED in the pixel driving circuit at the previous stage. In the process for initializing the pixel driving circuit at the previous stage, the first control terminal CR1 of the light emission driving module 01 in the pixel driving circuit at the current stage can be initialized. At the same time, the writing of the data voltage and the capturing of the threshold voltage can be completed in the process for initializing the pixel driving circuit at the current stage, thereby shortening the cycle and increasing the refresh frequency.

It is to be noted that the scheme in this embodiment in which, for pixel driving circuits at two adjacent stages, the first reference voltage signal line in the pixel driving circuit at one stage is connected to the anode of the OLED in the pixel driving circuit at the previous stage, can also be applied to other pixel driving circuits and pixel driving circuits according to the present disclosure.

The pixel driving circuit shown in FIG. 11 differs from the pixel driving circuit shown in FIG. 9 in that it does not include a threshold voltage capturing module, and the second input terminal IN2 of the connection control module 02 and the first output terminal OUT2 of the light emission driving module 01. That is, in an embodiment of the present disclosure, the drain of the first transistor T1 is directly electrically connected to the source of the second transistor T2. In addition, the second transistor T2 in the pixel driving circuit shown in FIG. 11 is an N-type transistor.

Figure 15:
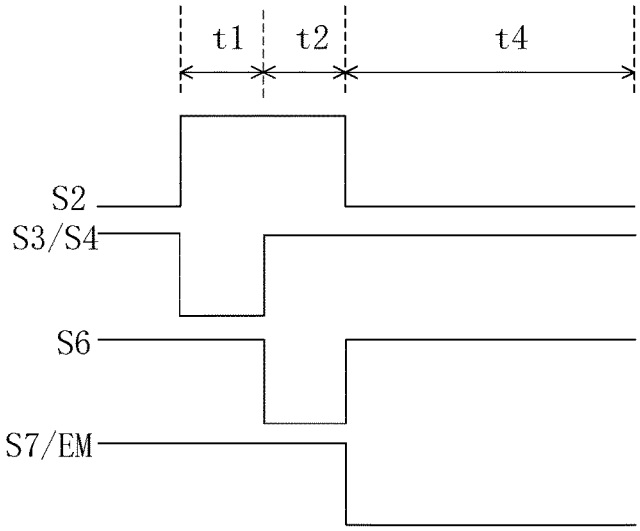
FIG. 15 is an operation timing diagram of the pixel driving circuit shown in FIG. 11.

FIG. 15 is an operation timing sequence diagram of the pixel driving circuit of FIG. 11. The operation timing sequence of the pixel driving circuit shown in FIG. 15 is basically the same as the operation timing sequence of the pixel driving circuit of FIG. 8 as shown in FIG. 13, except that the second transistor T2 is an N-type transistor while the other transistors are P-type transistors. Thus, in the initializing phase, the on signal that turns on the second transistor T2 should be a high level.

In order to better avoid current leakage, the second transistor T2 is an N-type transistor and its active layer is a metal oxide active layer with better stability.

It is to be noted that the scheme in this embodiment in which the second transistor T2 is provided as an N-type transistor can also be applied to other pixel driving circuits and pixel driving circuits according to the present disclosure. In addition, in order to better prevent the potential at the gate of the first transistor T1 from becoming unstable due to current leakage, the third transistor T3 and the fifth transistor T5 may also be N-type transistors and their active layers may also be metal oxide active layers.

Figure 16:
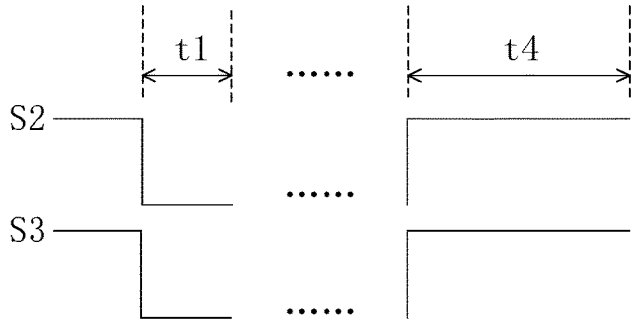
FIG. 16 is a timing sequence of a driving method for a pixel driving circuit according to an embodiment of the present disclosure.

According to an embodiment of the present disclosure, a driving method for a pixel driving circuit is also provided. FIG. 16 is a timing sequence diagram of a driving method for a pixel driving circuit according to an embodiment of the present disclosure. The driving method can be used to drive the pixel driving circuit according to any of the above embodiments.

Referring to FIG. 1, the pixel driving circuit according to the embodiment of the present disclosure includes a light emitting display module 00, a light emission driving module 01, a connection control module 02, and a first initializing module 03. The light emitting display module 00 includes an OLED for light emitting and displaying. The light emission driving module 01 includes a first control terminal CR1, a first input terminal IN1 and a first output terminal OUT1. The first output terminal OUT1 is electrically connected to the light emitting display module 00. The connection control module 02 includes a second input terminal IN2 and a second output terminal OUT2. The second output terminal OUT2 is connected to the first control terminal CR1 of the light emission driving module 01. In addition, the connection control module 02 may further include a second control terminal CR2 connected to a first scan line S2 and used to control the connected/disconnected state between the second input terminal IN2 and the second output terminal OUT2 of the connection control module 02. The first initializing module 03 includes a third input terminal IN3 and a third output terminal OUT3. The third input terminal IN3 is connected to a first reference voltage signal line Ref1, and the third output terminal OUT3 is connected to the second input terminal IN2. In addition, the first initializing module 03 further includes a third control terminal CR3, which is connected to a second scan line S3 and used to control the connected/disconnected state between the third input terminal IN3 and the third output terminal OUT3 of the first initializing module 03.

Referring to FIG. 16, the driving method includes the following.

In the initializing phase t1, the second scan line S3 receives an on signal, and the third control terminal CR3 connected to the second scan line S3 controls the third input terminal IN3 and the third output terminal OUT3 of the first initializing module 03 to be connected with each other. The first scan line S2 receives an on signal, the second control terminal CR2 connected to the first scan line S2 controls the second input terminal IN2 and the second output terminal OUT2 of the connection control module 02 to be connected with each other. A reference voltage is transmitted on the first reference voltage signal line Ref1, and the reference voltage is transmitted to the first control terminal CR1 through the first initializing module 03 and the connection control module 02 to initialize the first control terminal CR1.

In the light emitting phase t4, the second scan line S3 receives an off signal, and the third control terminal CR3 connected to the second scan line S3 controls the third input terminal IN3 and the third output terminal OUT3 of the first initializing module 03 to be disconnected from each other. The first scan line S2 receives an off signal, and the second control terminal CR2 connected to the first scan line S2 controls the second input terminal IN2 and the second output terminal OUT2 of the connection control module 02 to be disconnected from each other. The light emission driving module 01 transmits a light emission driving voltage to the light emitting display module 01.

Since the connection control module 02 is provided between the third output terminal OUT3 of the first initializing module 03 and the first control terminal CR1 of the light emission driving module 01, in the light emitting phase of the pixel driving circuit, the first initializing module 03 is disconnected from both the input terminal and the output terminal of the connection control module 02, so as to avoid a current leakage due to the first initializing module 03 not being completely turned off in the light emitting phase, which would otherwise affect the voltage at the first control terminal CR1 of the light emission driving module 01. In this way, the stability of light emission from the OLED in the light emission driving circuit can be guaranteed.

In an embodiment of the present disclosure, referring to FIGS. 2-7, the pixel driving circuit may further include a second initializing module 04, which includes a fourth input terminal IN4 and a fourth output terminal OUT4. The fourth input terminal IN4 is connected to the second reference voltage signal line Ref2, and the fourth output terminal OUT4 is connected to the anode of the OLED;

The driving method further includes the following.

In the initializing phase t1, the fourth control terminal CR4 connected to the third scan line S4 controls the fourth input terminal IN4 and the fourth output terminal OUT4 of the second initializing module 04 to be connected with each other. A reference voltage is transmitted on the second reference voltage signal line Ref, and the reference voltage is transmitted to the anode of the OLED through the second initializing module 04.

It is to be noted that the first reference voltage signal line Ref1 can be reused as the second reference voltage signal line Ref2. That is, in the initializing phase, the first control terminal CR1 of the light emission driving module 01 and the anode of the OLED can be initialized simultaneously. Alternatively, the first reference voltage signal line Ref1 may not be reused as the second reference voltage signal line Ref2. The initializing phase can include one phase for initializing the first control terminal CR1 of the light emission driving module 01 and another phase for initializing the anode of the OLED.

In an embodiment of the present disclosure, referring to FIG. 2, FIG. 3, FIG. 5 and FIG. 6, the pixel driving circuit may further include a threshold voltage capturing module 05 and a first capacitor C1. The threshold voltage capturing module 05 includes a fifth input terminal IN5 and a fifth output terminal OUT5. The fifth input terminal IN5 is connected to the first output terminal OUT1, and the fifth output terminal OUT5 is connected to the second input terminal IN2. The first capacitor C1 has a first electrode plate electrically connected to the first control terminal CR1.

The driving method further includes the following.

In the threshold voltage capturing phase t2, the fifth control terminal CR5 connected to the fourth scan line S5 controls the fifth input terminal IN5 and the fifth output terminal OUT5 of the threshold voltage capturing module 05 to be connected with each other. The second control terminal CR2 connected to the first scan line S2 controls the second input terminal IN2 and the second output terminal OUT2 of the connection control module 02 to be connected with each other. A power supply voltage or the data voltage is written into the first control terminal CR1 of the light emission driving module 01 through the connection control module 02 and the threshold voltage capturing module 05.

In the light emitting phase t4, the fifth control terminal CR5 connected to the fourth scan line S5 controls the fifth input terminal IN5 and the fifth output terminal OUT5 of the threshold voltage capturing module 05 to be disconnected from each other.

In an embodiment of the present disclosure, referring to FIGS. 2 and 5, the pixel driving circuit may further include a data signal writing module 06, which includes a sixth input terminal IN6 and a sixth output terminal OUT6. The sixth input terminal IN6 is connected to the data voltage line Data, and the sixth output terminal OUT6 is connected to the second electrode plate of the first capacitor C1. The first input terminal IN1 is connected to the power supply voltage signal line PVDD.

The driving method further includes the following.

In the threshold voltage capturing phase t2, a power supply voltage is transmitted on the power supply voltage signal line PVDD, and the power supply voltage is stored in the first capacitor C1 through the light emission driving module 01, the threshold voltage capturing module 05, and the connection control module 02.

In the data signal writing phase t3, the sixth control terminal CR6, which is connected to the fifth scan line S6 and controls the sixth input terminal IN6, and the sixth output terminal OUT6 of the data signal writing module 06 are to be connected with each other. A data voltage is transmitted on the data voltage line Data, and the data voltage is stored in the first capacitor C1 through the data signal writing module 06.

In an embodiment of the present disclosure, referring to FIGS. 3 and 6, the pixel driving circuit may further include a data signal writing module 06 and a power supply voltage writing module 07. The data signal writing module 06 includes a sixth input terminal IN6 and a sixth output terminal OUT6. The sixth input terminal IN6 is connected to the data voltage line Data, and the sixth output terminal OUT6 is connected to the first input terminal IN1. The power supply voltage writing module 07 includes a seventh input terminal IN7 and a seventh output terminal OUT7. The seventh input terminal IN7 is connected to the power supply voltage signal line PVDD, and the seventh output terminal OUT7 is connected to the first input terminal IN1.

The driving method includes the following.

In the threshold voltage capturing phase t2, the sixth control terminal CR6, which is connected to the fifth scanning line S6 and controls the sixth input terminal IN6, and the sixth output terminal OUT6 of the data signal writing module 06 are to be connected with each other. A data voltage is transmitted on the data voltage line Data, and the data voltage is stored in the first capacitor C1 through the data signal writing module 06, the light emission driving module 01, the threshold voltage capturing module 05, and the connection control module 02.

In the light emitting phase t4, the sixth input terminal IN6 and the sixth output terminal OUT6 of the data signal writing module 06 are disconnected from each other, and the seventh control terminal CR7 connected to the sixth scanning line S7 controls the seventh input terminal IN7 and the seventh output terminal OUT7 of the power supply voltage writing module 07 are to be connected with each other.

Referring to FIGS. 4 and 7, the second input terminal IN2 is connected to the first output terminal OUT1. The pixel driving circuit further includes a data signal writing module 06 and a power supply voltage writing module 07. The data signal writing module 06 includes a sixth input terminal IN6 and a sixth output terminal OUT6. The sixth input terminal IN6 is connected to the data voltage line Data, and the sixth output terminal OUT6 is connected to the first input terminal IN1. The power supply voltage writing module 07 includes a seventh input terminal IN7 and a seventh output terminal OUT7. The seventh input terminal IN7 is connected to the power supply voltage signal line PVDD, and the seventh output terminal OUT7 is connected to the first input terminal IN1.

In the threshold voltage capturing phase t2, the sixth control terminal CR6, which is connected to the fifth scan line S6 and controls the sixth input terminal IN6, and the sixth output terminal OUT6 of the data signal writing module 06 are to be connected with each other. A data voltage is transmitted on the data voltage line Data, and the data voltage is stored in the first capacitor C1 through the data signal writing module 06, the light emission driving module 01, and the connection control module 02.

In the light emitting phase t4, the sixth control terminal CR6 connected to the fifth scan line S6 controls the sixth input terminal IN6 and the sixth output terminal OUT6 of the data signal writing module 06 to be disconnected from each other. The seventh control terminal CR7, which is connected to the sixth scanning line S7 and controls the seventh input terminal IN7, and the seventh output terminal OUT7 of the power supply voltage writing module 07 are to be connected with each other.

In the driving method for the pixel driving circuit according to the embodiment of the present disclosure, the first initializing module 01 and/or the threshold voltage capturing module 05 are connected to the first control terminal CR1 of the light emission driving module 01 through the connection control module 01. In the light emitting phase of the pixel driving circuit, the input terminal and the output terminal of the connected control module 02 are disconnected from each other, that is, the first initializing module 03 and/or the threshold voltage capturing module 05 is disconnected from the first control terminal CR1 of the light emission driving module 01 simultaneously, so as to avoid the current leakage due to the first initializing module 03 and/or the threshold voltage capturing module 05 not being completely turned off in the light emitting phase, which would otherwise affect the voltage at the first control terminal CR1 of the light emission driving module 01, thereby guaranteeing the stability of light emission from the OLED in the light emission driving circuit.

Figure 17:
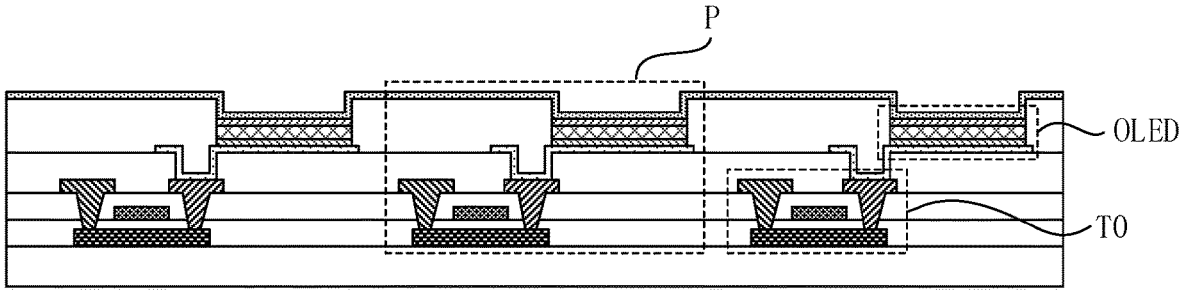
FIG. 17 is a schematic diagram showing an organic light emitting display panel according to an embodiment of the present disclosure.

FIG. 17 is a schematic diagram of an organic light emitting display panel according to an embodiment of the present disclosure. The organic light emitting display panel according to the embodiment of the present disclosure includes the pixel driving circuit according to any of the above embodiments. As shown in FIG. 17, the organic light emitting display panel according to the embodiment of the present disclosure includes a plurality of pixel units P, each corresponding to a pixel driving circuit. In addition, the OLED and the transistors in the pixel driving circuit are located in different film layers. The light emission control transistor T0 and the OLED are electrically connected with each other through a via.

In the organic light emitting display panel according to the embodiment of the present disclosure, the voltage at the first control terminal of the light emission driving module in the pixel driving circuit is stable, and the light emission driving voltage transmitted from the light emission driving module to the light emitting display module is stable. Therefore, the display quality of the organic light emitting display panel is good.

In addition, the organic light emitting display panel according to the embodiment of the present disclosure can be applied to organic light emitting display devices, such as mobile phones, computers, and televisions. The organic light emitting display device includes a display area and a non-display area surrounding the display area, and correspondingly the pixel driving circuit is provided in the display area.

While the preferred embodiments of the present disclosure have been described above, the scope of the present disclosure is not limited thereto. Various modifications, equivalent alternatives or improvements can be made by those skilled in the art without departing from the scope of the present disclosure. These modifications, equivalent alternatives and improvements are to be encompassed by the scope of the present disclosure.

What is claimed is:

1. A pixel driving circuit, comprising:

a light emitting display module, comprising an Organic Light Emitting Diode (OLED);

a light emission driving module, comprising a first control terminal, a first input terminal and a first output terminal, the first output terminal being electrically connected to the light emitting display module;

a connection control module, comprising a second input terminal and a second output terminal, the second output terminal being connected to the first control terminal of the light emission driving module;

a first initializing module, comprising a third input terminal and a third output terminal, the third input terminal being connected to a first reference voltage signal line and the third output terminal being connected to the second input terminal;

a threshold voltage capturing module, comprising a fifth input terminal and a fifth output terminal, the fifth input terminal being connected to the first output terminal and the fifth output terminal being connected to the second input terminal; and a first capacitor having a first electrode plate electrically connected to the first control terminal.

2. The pixel driving circuit according to claim 1, wherein the light emission driving module comprises a first transistor having a gate connected to the first control terminal, a source connected to the first input terminal, and a drain connected to the first output terminal.

3. The pixel driving circuit according to claim 1, wherein the connection control module comprises a second transistor having a source connected to the second input terminal and a drain connected to the second output terminal.

4. The pixel driving circuit according to claim 1, wherein the first initializing module comprises a third transistor having a source connected to the third input terminal and a drain connected to the third output terminal.

5. The pixel driving circuit according to claim 1, wherein the pixel driving circuit further comprises:

a second initializing module, comprising a fourth input terminal and a fourth output terminal, the fourth input terminal being connected to a second reference voltage signal line and the fourth output terminal being connected to an anode of the OLED.

6. The pixel driving circuit according to claim 5, wherein the second initializing module comprises:

a fourth transistor having a source connected to the fourth input terminal, and a drain connected to the fourth output terminal.

7. The pixel driving circuit according to claim 1, wherein the threshold voltage capturing module comprises:

a fifth transistor having a source connected to the fifth input terminal, and a drain connected to the fifth output terminal.

8. The pixel driving circuit according to claim 1, wherein the pixel driving circuit further comprises:

a data signal writing module, comprising a sixth input terminal and a sixth output terminal, the sixth input terminal being connected to a data voltage line and the sixth output terminal being connected to a second electrode plate of the first capacitor, wherein the first input terminal is connected to a power supply voltage signal line.

9. The pixel driving circuit according to claim 8, wherein the data signal writing module comprises:

a sixth transistor having a source connected to the sixth input terminal, and a drain connected to the sixth output terminal.

10. The pixel driving circuit according to claim 1, wherein the pixel driving circuit further comprises:

a data signal writing module, comprising a sixth input terminal and a sixth output terminal, the sixth input terminal being connected to a data voltage line and the sixth output terminal being connected to the first input terminal; and a power supply voltage writing module, comprising a seventh input terminal and a seventh output terminal, the seventh input terminal being connected to a power supply voltage signal line and the seventh output terminal being connected to the first input terminal.

11. The pixel driving circuit according to claim 10, wherein the data signal writing module comprises a sixth transistor having a source connected to the sixth input terminal and a drain connected to the sixth output terminal, and the power supply voltage writing module comprises a seventh transistor having a source connected to the seventh input terminal and a drain connected to the seventh output terminal.

12. The pixel driving circuit according to claim 1, wherein the second input terminal is connected to the first output terminal, and the pixel driving circuit further comprises:

a data signal writing module, comprising a sixth input terminal and a sixth output terminal, the sixth input terminal being connected to a data voltage line and the sixth output terminal being connected to the first input terminal; and a power supply voltage writing module, comprising a seventh input terminal and a seventh output terminal, the seventh input terminal being connected to a power supply voltage signal line and the seventh output terminal being connected to the first input terminal.

13. A driving method for a pixel driving circuit, wherein the pixel driving circuit comprises:

a light emitting display module, comprising an Organic Light Emitting Diode (OLED);

a light emission driving module, comprising a first control terminal, a first input terminal and a first output terminal, the first output terminal being electrically connected to the light emitting display module;

a connection control module, comprising a second input terminal and a second output terminal, the second output terminal being connected to the first control terminal of the light emission driving module;

a first initializing module, comprising a third input terminal and a third output terminal, the third input terminal being connected to a first reference voltage signal line and the third output terminal being connected to the second input terminal;

a threshold voltage capturing module, comprising a fifth input terminal and a fifth output terminal, the fifth input terminal being connected to the first output terminal and the fifth output terminal being connected to the second input terminal; and a first capacitor having a first electrode plate electrically connected to the first control terminal, the driving method comprising:

in an initializing phase, connecting the third input terminal and the third output terminal of the first initializing module with each other, connecting the second input terminal and the second output terminal of the connection control module with each other, and transmitting a reference voltage on the first reference voltage signal line, the reference voltage being transmitted to the first control terminal through the first initializing module and the connection control module; and in a light emitting phase, disconnecting the third input terminal and the third output terminal of the first initializing module from each other, disconnecting the second input terminal and the second output terminal of the connection control module from each other, and the light emission driving module transmitting a light emission driving voltage to the light emitting display module.

14. The driving method according to claim 13, wherein the pixel driving circuit further comprises a second initializing module comprising a fourth input terminal and a fourth output terminal, the fourth input terminal being connected to a second reference voltage signal line and the fourth output terminal being connected to an anode of the OLED, and the driving method further comprises:

in the initializing phase, connecting the fourth input terminal and the fourth output terminal of the second initializing module with each other, and transmitting the reference voltage on the second reference voltage signal line, the reference voltage being transmitted to the anode of the OLED through the second initializing module.

15. The driving method according to claim 13, wherein the driving method further comprises:

in a threshold voltage capturing phase, connecting the fifth input terminal and the fifth output terminal of the threshold voltage capturing module with each other, and connecting the second input terminal and the second output terminal of the connection control module with each other; and in the light emitting phase, disconnecting the fifth input terminal and the fifth output terminal of the threshold voltage capturing module from each other.

16. The driving method according to claim 15, wherein the pixel driving circuit further comprises a data signal writing module comprising a sixth input terminal and a sixth output terminal, the sixth input terminal being connected to a data voltage line, the sixth output terminal being connected to a second electrode plate of the first capacitor, the first input terminal being connected to a power supply voltage signal line, and the driving method further comprises:

in the threshold voltage capturing phase, transmitting a power supply voltage on the power supply voltage signal line, and storing the power supply voltage in the first capacitor through the light emission driving module, the threshold voltage capturing module, and the connection control module, and in a data signal writing phase, connecting the sixth input terminal and the sixth output terminal of the data signal writing module with each other, transmitting a data voltage on the data voltage line, and storing the data voltage in the first capacitor through the data signal writing module.

17. The driving method of claim 15, wherein the pixel driving circuit further comprises a data signal writing module and a power supply voltage writing module; the data signal writing module comprising a sixth input terminal and a sixth output terminal, the sixth input terminal being connected to a data voltage line and the sixth output terminal being connected to the first input terminal, the power supply voltage writing module comprising a seventh input terminal and a seventh output terminal, the seventh input terminal being connected to a power supply voltage signal line and the seventh output terminal being connected to the first input terminal, and the driving method further comprises:

in the threshold voltage capturing phase, connecting the sixth input terminal and the sixth output terminal of the data signal writing module with each other, transmitting a data voltage on the data voltage line, and storing the data voltage in the first capacitor through the data signal writing module, the light emission driving module, the threshold voltage capturing module and the connection control module; and in the light emitting phase, disconnecting the sixth input terminal and the sixth output terminal of the data signal writing module from each other, and connecting the seventh input terminal and the seventh output terminal of the power supply voltage writing module with each other.

18. The driving method according to claim 13, wherein the second input terminal is connected to the first output terminal, and the pixel driving circuit further comprises a data signal writing module and a power supply voltage writing module, the data signal writing module comprising a sixth input terminal and a sixth output terminal, the sixth input terminal being connected to a data voltage line and the sixth output terminal being connected to the first input terminal, the power supply voltage writing module comprising a seventh input terminal and a seventh output terminal, the seventh input terminal being connected to a power supply voltage signal line and the seventh output terminal being connected to the first input terminal, and the driving method further comprises:

in a threshold voltage capturing phase, connecting the sixth input terminal and the sixth output terminal of the data signal writing module with each other, transmitting a data voltage on the data voltage line, and storing the data voltage in the first capacitor through the data signal writing module, the light emission driving module and the connection control module; and in the light emitting phase, disconnecting the sixth input terminal and the sixth output terminal of the data signal writing module from each other, and connecting the seventh input terminal and the seventh output terminal of the power supply voltage writing module with each other.

19. An organic light emitting display panel, comprising a pixel driving circuit, wherein the pixel driving circuit comprises:

a light emitting display module, comprising an Organic Light Emitting Diode (OLED);

a light emission driving module, comprising a first control terminal, a first input terminal and a first output terminal, the first output terminal being electrically connected to the light emitting display module;

a connection control module, comprising a second input terminal and a second output terminal, the second output terminal being connected to the first control terminal of the light emission driving module;

a first initializing module, comprising a third input terminal and a third output terminal, the third input terminal being connected to a first reference voltage signal line and the third output terminal being connected to the second input terminal;

a threshold voltage capturing module, comprising a fifth input terminal and a fifth output terminal, the fifth input terminal being connected to the first output terminal and the fifth output terminal being connected to the second input terminal; and a first capacitor having a first electrode plate electrically connected to the first control terminal.

* * * * *